US011168954B1

(12) United States Patent
Spykerman et al.

(10) Patent No.: US 11,168,954 B1
(45) Date of Patent: Nov. 9, 2021

(54) FIREARM MAGAZINE EXTENDERS HAVING LATERALLY-INTERLOCKING ENCLOSURE PIECES

(71) Applicant: XTech Tactical, LLC, Chandler, AZ (US)

(72) Inventors: David Spykerman, Chandler, AZ (US); Leif Strom, Scottsdale, AZ (US)

(73) Assignee: XTech Tactical, LLC, Tempe, AZ (US)

( * ) Notice: Subject to any disclaimer, the term of this patent is extended or adjusted under 35 U.S.C. 154(b) by 0 days.

(21) Appl. No.: 17/115,386

(22) Filed: Dec. 8, 2020

(51) Int. Cl.
*F41A 9/71* (2006.01)
*F41A 9/70* (2006.01)

(52) U.S. Cl.
CPC . *F41A 9/71* (2013.01); *F41A 9/70* (2013.01)

(58) Field of Classification Search
CPC ..... F41A 9/65; F41A 9/70; F41A 9/71
USPC ..... 42/49.01, 49.02, 50
See application file for complete search history.

(56) References Cited

U.S. PATENT DOCUMENTS

| | | | | |
|---|---|---|---|---|
| 4,343,107 | A | 8/1982 | Kaltenegger | |
| 4,397,109 | A | 8/1983 | Pachmayr et al. | |
| 4,495,720 | A | 1/1985 | Bross | |
| 4,514,922 | A | 5/1985 | Farrar et al. | |
| 4,592,160 | A | 6/1986 | Bross | |
| 4,862,619 | A | 9/1989 | Baldus et al. | |
| 5,081,778 | A | 1/1992 | Switzer | |
| 5,438,783 | A | 8/1995 | Sniezak et al. | |
| 5,526,600 | A | 6/1996 | Chesnut et al. | |
| 5,584,136 | A | 12/1996 | Boland et al. | |
| 5,666,752 | A | 9/1997 | Grams | |
| 6,557,287 | B2 | 5/2003 | Wollmann | |
| 6,568,115 | B2 | 5/2003 | Beretta | |
| 7,117,622 | B2 | 10/2006 | Freed et al. | |
| 7,200,963 | B1 | 4/2007 | Vieweg | |
| 8,863,423 | B2 | 10/2014 | Clifton, Jr. | |
| 8,925,231 | B2 | 1/2015 | Lee | |
| 9,772,151 | B1 | 9/2017 | Sanderson et al. | |
| 10,190,835 | B2 * | 1/2019 | Hsu | F41A 9/71 |
| 10,852,086 | B1 * | 12/2020 | Hillis | F41A 9/71 |
| 2015/0096214 | A1 | 4/2015 | Jones, III | |
| 2017/0321979 | A1 | 11/2017 | Szczepkowski et al. | |

(Continued)

*Primary Examiner* — Reginald S Tillman, Jr.
(74) *Attorney, Agent, or Firm* — Justin J. Leach

(57) ABSTRACT

A firearm magazine extender is installable onto a firearm magazine having a lower end portion from which magazine flanges project. Embodiments of the firearm magazine extender include a first enclosure piece, a second enclosure piece, and a laterally-interlocking interface formed between the first and second enclosure pieces. The first enclosure piece includes, in turn, laterally-flexible sidewalls spaced along a lateral axis of the firearm magazine extender, and retention slots formed in the laterally-flexible sidewalls and into which the magazine flanges engage when the first enclosure piece is fit onto the firearm magazine. The second enclosure piece is configured to matingly engage the first enclosure piece and cooperate therewith to enclose the lower end portion of the firearm magazine. The laterally-interlocking interface inhibits deflection of the laterally-flexible sidewalls and disengagement of the magazine flanges from the retention slots when the firearm magazine extender is installed on the firearm magazine.

20 Claims, 14 Drawing Sheets

(56) References Cited

U.S. PATENT DOCUMENTS

| | | | | |
|---|---|---|---|---|
| 2018/0031342 | A1* | 2/2018 | Faifer | F41A 9/70 |
| 2020/0103189 | A1* | 4/2020 | Cass | F41A 9/65 |

* cited by examiner

FIREARM MAGAZINE EXTENDERS HAVING LATERALLY-INTERLOCKING ENCLOSURE PIECES

TECHNICAL FIELD

The following disclosure relates to firearm magazines and, more particularly, to firearm magazine extenders including laterally-interlocking enclosure pieces, which are capable of securely attaching to a wide range of firearm magazines.

BACKGROUND

The round-carrying capacity of certain firearm magazines can be expanded through user installation of a passive retrofit device commonly referred to as a "magazine extender." Often, such magazine extenders attach to a firearm magazine by engaging lower tabs or flanges, which project laterally outwardly from opposing bottom peripheral edges of the magazine. Several types of magazine extenders have been developed and are presently commercially available. The design and construction of existing magazine extenders vary depending upon firearm magazine compatibility and other factors. Regardless of its particular design, a magazine extender is ideally capable of remaining securely attached to a firearm magazine until subsequent removal by a user. It is generally critical that inadvertent detachment of the magazine extender is avoided in adverse conditions including when, for example, significant shock (mechanical impact) forces are imparted to the magazine extender during firearm training or real-world usage scenarios. Concurrently, it is desirable for a given firearm magazine extender to possess a relatively straightforward, low part count design facilitating user installation on a chosen firearm magazine.

BRIEF DESCRIPTION OF THE DRAWINGS

At least one example of the present invention will hereinafter be described in conjunction with the following figures, wherein like numerals denote like elements, and.

Figure 1:
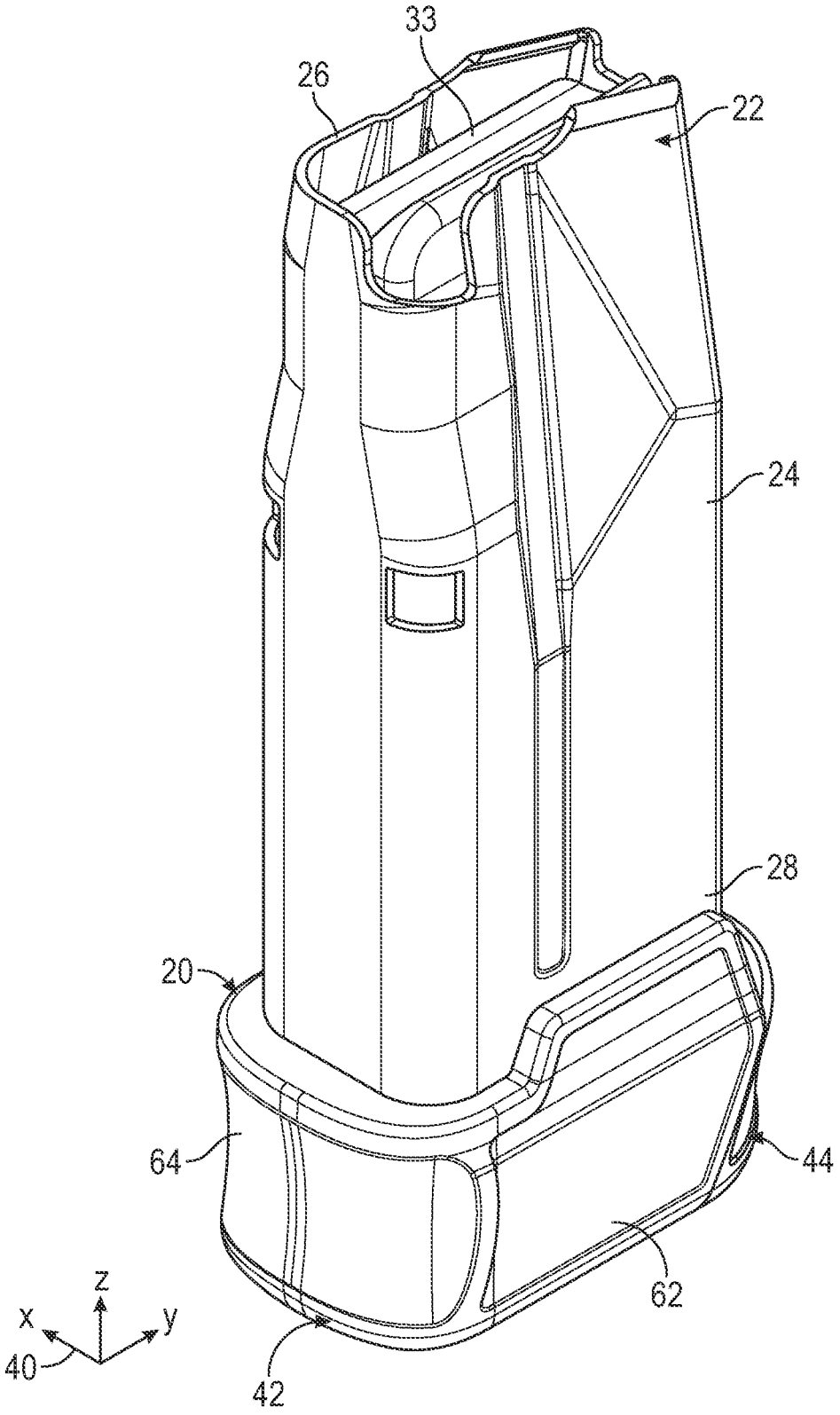
FIG. 1 is an isometric view of a firearm magazine extender installed on a lower end portion of a firearm magazine having interior (inwardly-projecting) flanges, which are received into retention slots provided in an inner enclosure piece of the magazine extender, as illustrated in accordance with a first example embodiment of the present disclosure.

For simplicity and clarity of illustration, descriptions and details of well-known features and techniques may be omitted to avoid unnecessarily obscuring the example and non-limiting embodiments of the invention described in the subsequent Detailed Description. It should further be understood that features or elements appearing in the accompanying figures are not necessarily drawn to scale unless otherwise stated.

DETAILED DESCRIPTION

The following Detailed Description is merely example in nature and is not intended to limit the invention or the application and uses of the invention. Furthermore, there is no intention to be bound by any theory presented in the preceding Background or the following Detailed Description.

As appearing herein, the term "magazine flange" or, more simply, "flange" broadly encompasses any projection or protruding feature extending from a sidewall or other surface of a firearm magazine, regardless of the particular shape or geometry of the projection or flange. Similarly, the term "retention slot" refers to any groove, depression, cavity, or other opening in which a magazine flange is received to retain or help retain a magazine extender in an installed position on a firearm magazine. As described below, such retention slots may be formed in laterally-flexible sidewalls of an enclosure piece. The descriptor "laterally flexible," as appearing in the term "laterally-flexible sidewalls" denotes only that each sidewall is not infinitely stiff, but rather is capable of deflecting in at least one lateral direction (e.g., when the magazine extender is subject to mechanical impact or other dislodgment forces) in a manner permitting undesired withdrawal of the magazine flanges from their associated retention slots and, therefore, unintended magazine extender detachment, absent the provision of the below-described laterally-interlocking features of the magazine extender enclosure pieces. Lastly, as further appearing herein, terms of orientation, such as "upper," "lower," "bottom," and "top," are defined in relation to the magazine extender when in an upright orientation; e.g., the orientation of the magazine extender when inserted into the well of a firearm having a conventional, bottom-loading design, with the firearm leveled such that the firearm barrel extends perpendicular to the direction of gravity.

Overview

A firearm magazine typically includes a tubular magazine body, which terminates in a lower end portion from which two or more magazine tabs or flanges project in opposing lateral directions. Commonly, the magazine flanges project from opposing, laterally-spaced edges of the magazine body in outward directions, with magazine flanges of this type referred to hereafter as "exterior magazine flanges" or, more succinctly, "exterior flanges." In addition to a tubular magazine body and magazine flanges, a firearm magazine may also include a substantially flat (e.g., stamped metal) piece referred to as a "base plate." The side edges of the base plate are curled or otherwise shaped to define slots in which the magazine flanges are received when the base plate is slid into engagement with the lower end of the firearm magazine. When so attached, the base plate encloses the lower end portion of the tubular magazine body, while the upper end of the tubular magazine body remains open to enable the reception and discharge of ammunition rounds from the magazine. Prior to attachment of the base plate, a spring follower and a magazine spring are inserted into the open lower end of the tubular magazine body. The spring follower may have generally rectangular planform shape, which is dimensioned to provide a close fitting relationship with the interior chamber or channel of the tubular magazine body. The spring follower travels vertically within the tubular magazine body, while the upper end portion of the tubular magazine body is typically tapered or otherwise partially enclosed to prevent the spring follower from exiting the magazine body through its upper end. The magazine spring, conventionally provided as a wireform compression spring having rectangular coils, is compressed between the spring follower and the base plate. As ammunition rounds are loaded into the magazine channel, the magazine spring further compresses to accommodate the newly-received rounds. The compressed magazine spring exerts an upward force on the spring follower, which urges the magazine rounds to travel upwardly through the open upper end of the firearm magazine and into the chamber of a firearm having a well into which the firearm magazine is inserted.

The round-carrying capacities of many firearm magazines can be expanded through retrofit installation of a magazine extender onto a lower end portion of the firearm magazine. As indicated above, it is generally critical for such firearm magazine extender, once installed on a selected firearm magazine, to remain securely attached to the firearm magazine until subsequent user removal. Attachment schemes for securing a magazine extender to a compatible firearm magazine are thus ideally sufficiently robust to overcome the expansive force exerted by the magazine spring urging magazine extender separation, particularly when the firearm magazine is loaded to capacity and the magazine spring is fully compressed. Unintended magazine extender detachment should also be prevented when significant impact (mechanical shock) forces are imparted to the magazine extender as may occur during firearm training or firearm usage in certain real-world scenarios. Generally, the technical challenges involved in designing a robust attachment interface for securing a magazine extender to a particular firearm magazine are eased when the firearm magazine is fabricated to include exterior (outwardly-projecting) flanges having relatively wide dimensions, as measured along a lateral axis of the firearm magazine; e.g., from left to right when viewing a firearm magazine from a straight on or head-on viewpoint, while the magazine is in an upright orientation. Certain firearm magazines are fabricated to include relatively narrow magazine flanges, however, which renders the task of securely attaching a firearm magazine extender to the firearm magazine increasingly difficult. A still greater technical challenge is encountered when a given firearm magazine extender is desirably attached to a firearm magazine having interior (inwardly-projecting) magazine flanges, which cannot be readily accessed from the exterior of the tubular magazine body. Evidencing this technical challenging, there presently exists relatively few, if any commercially obtainable magazine extenders compatible with firearm magazine extenders having interior magazine flanges. An ongoing industrial demand thus exists for firearm magazine extenders capable of providing structurally-robust, secure attachment to a broad range of firearm magazines, including firearm magazines having interior and/or relatively narrow magazine flanges.

In satisfaction of the above-described industry demand, the following discloses firearm magazine extenders having unique, laterally-interlocking enclosure pieces, which enable magazine extender attachment to a wide range of firearm magazines, including firearm magazines having interior magazine flanges and relatively narrow magazine flanges. Embodiments of the magazine extender include at least first and second enclosure pieces, which are structurally configured for mating assembly onto the lower end portion of a compatible firearm magazine. The first enclosure piece includes retention slots, such as elongated grooves or other depressions, which are size and shaped to receive the magazine flanges when the magazine extender is installed on the firearm magazine. The retention slots are formed in laterally-flexible sidewalls of the first enclosure piece; that is, sidewalls of the first enclosure piece are sufficiently flexible in lateral directions to potentially permit unintended flange-slot withdrawal (e.g., in the presence of mechanical shock forces) absent the laterally-interlocking design of the enclosure pieces. The first enclosure piece further includes a first set of lateral interlock features, which project from the laterally-flexible sidewalls in opposing directions. Similarly, a second enclosure piece includes a second, corresponding set of lateral interlock features, which are placed in engagement with the first set of lateral interlock features when the second enclosure piece is assembled with the first enclosure piece. Interlocking engagement of the lateral interlock features effectively reinforces or bolsters the laterally-flexible sidewalls of the first enclosure piece in a manner reducing the susceptibility of the laterally-flexible to lateral deflection following installation of the magazine extender on a chosen firearm magazine. This, in turn, reduces the likelihood of undesired withdrawal of the magazine flanges from the retention slots, while the firearm magazine remains in its assembled state. Unintentional detachment of the magazine extender from the firearm magazine is consequently precluded, including in instances in which significant impact forces are imparted to the magazine extender, until purposeful disassembly and detachment of the magazine extender by a user. Concurrently, a structurally robust, low part count design is provided facilitating user installation of the magazine extender onto a selected firearm magazine.

By virtue of the above-mentioned laterally-interlocking enclosure piece interface, embodiments of the firearm extender can be adapted for secure attachment to firearm magazine having various structural features, including interior (inwardly-projecting) tabs or magazine flanges. In the latter regard, embodiments of the firearm magazine extender may include an inner enclosure piece bearing the previously-noted laterally-flexible sidewalls and retention slots. Due to the lateral flexibility of the sidewalls, particularly as considered at the uppermost end portions of the sidewalls, the inner enclosure piece is amenable to deflection during press-fit or snap-fit insertion into the open lower end portion of the firearm magazine. Specifically, during user insertion into the firearm magazine, uppermost portions or sections of the laterally-flexible sidewalls deflect inwardly (laterally converge or pinch) to allow passage of uppermost sidewall portions until the retention slots align with the interior flanges. When the first enclosure piece is moved into a position at which the retention slots and the magazine flanges align, the laterally-flexible sidewalls return to their non-deflected design position (deflect outwardly) to receive the magazine flanges into the retention slots; or, stated differently, the uppermost portion of the inner enclosure piece snaps into the lower open end of the firearm magazine as the internal magazine flanges register into the retention slots. Engagement of the interior magazine flanges into the retention slots helps maintain the inner enclosure piece in its desired position against the lower peripheral edge of the magazine; however, due to the propensity of the laterally-flexible sidewalls to splay or pinch inwardly in a manner permitting magazine flanges disengagement from the retention slots, only a relatively tenuous mechanical attachment is provided by this attachment interface considered in isolation. This is addressed through subsequent user attachment of an outer enclosure piece, which is next assembled with the inner enclosure piece such that a portion of the inner enclosure piece is received into the outer enclosure piece. The outer enclosure piece includes a second set of lateral interlock features, which matingly engages the corresponding lateral interlock features of the inner enclosure piece to reinforce or bolster the laterally-flexible sidewalls of the inner enclosure piece, thereby deterring the disengagement of the interior magazine flanges from the retention slots.

The above-mentioned lateral interlock features can assume any form suitable for physically tying or anchoring the laterally-flexible sidewalls of the inner enclosure piece to the adjacent sidewalls of the outer enclosure piece. In effect, the lateral interlock features, along with the other surrounding structure of the inner and outer enclosure pieces, combine to form a dual wall structure when the magazine extender. The dual wall structure possesses a high lateral stiffness, which significantly deters, if not wholly prevents undesired lateral displacement or deflection of the laterally-flexible sidewalls and corresponding disengagement of the magazine flanges from the retention slots. To optimize the effectiveness of this structure, the first set of lateral interlock features is beneficially formed in relatively close proximity to the retention slots; e.g., the first set of lateral interlock features may project outwardly from the laterally-flexible sidewalls of the inner enclosure piece at locations immediately beneath the retention slots in at least some implementations. In embodiments, the first set of lateral interlock features may assume the form of laterally-spaced attachment rails, which are elongated in longitudinal directions and which are imparted with hook-shaped (e.g., L-shaped) cross-sectional geometries opening in a first (e.g., downward) direction. Correspondingly, the second set of lateral interlock features, as formed in the outer enclosure piece, may be realized as elongated lateral-reinforcement rails likewise possessing hook-shaped (e.g., L-shaped) cross-sectional geometries, which open in a second, opposing (e.g., upward) direction. As the outer enclosure piece is assembled onto the inner enclosure piece, the lateral-reinforcement rails slide into mating engagement with the corresponding attachment rails to yield the laterally-interlocking interface bolstering or buffering the laterally-flexible sidewalls of the inner enclosure piece against inward lateral deflection.

Embodiment of the firearm magazine extender are thus capable of securely attaching to a firearm magazine having interior (inwardly-projecting) flanges, while also providing a robust, low part count design streamlining user installation on a selected firearm magazine. This stated, embodiments of the magazine extender are not restricted to usage with firearm magazines having interior flanges. Rather, embodiments of the magazine extender can be readily adapted for usage in conjunction with firearm magazines having exterior (outwardly-projecting) flanges, including exterior flanges having relatively narrow widths. In this latter case, the above-mentioned laterally-flexible sidewalls, retention slots, and attachment rails (or a first set of analogous lateral interlock features) may be formed in the outer enclosure piece of the magazine extender, while the above-described lateral-reinforcement rails (or a second set of analogous lateral interlock features) are formed in the inner enclosure piece. When installed on a selected firearm magazine, the inner enclosure piece may first be positioned in an abutting relationship with a lower portion of firearm magazine; e.g., such that a lower surface of the magazine contacts an upper surface of the lateral-reinforcement rails. The outer enclosure piece is assembled onto the inner enclosure piece such that the inner enclosure piece inserts into or nests within the outer enclosure piece. When the magazine extender is assembled, the lateral-reinforcement rails engage the attachment rails in a laterally-interlocking relationship; e.g., such that the rails effectively hook or clasp together in lateral directions. Absent the laterally-interlocking rail-to-rail interface, the laterally-flexible sidewalls of the outer enclosure piece may be undesirably prone to lateral splay, potentially permitting undesired flange-slot withdrawal and unintended magazine extender detachment. The provision of the interlocking multi-wall structure, as formed between the attachment rails of the outer enclosure piece and the lateral-reinforcement rails of the inner enclosure piece, yields a high stiffness, multi-wall structure deterring lateral deflection of the laterally-flexible sidewalls and disengagement of the magazine flanges from the retention slots. Consequently, the magazine extender is affixed onto the firearm magazine in a highly secure manner, preventing inadvertent detachment of the magazine extender in the presence of mechanical shock forces and despite any potential narrow dimensioning of the external magazine flanges.

Embodiments of the firearm magazine extender include other beneficial structural features and attributes in addition to those noted above. For example, embodiments of the magazine extender may include a base plate having a lower protuberance or "button projection," which is received into aligning apertures formed in the bottom walls of the enclosure pieces to lock the enclosure pieces in their desired positions when the magazine extender is assembled. A tapered lower end of an extended magazine spring (e.g., a magazine spring having a free length greater than that of an original equipment manufacturer (OEM) spring of the firearm magazine) may engage a contact surface or "spring seat," which is provided on the base plate opposite the button projection. When installing the magazine extender onto a firearm magazine, a user may initially remove the pre-existing or OEM magazine spring and base plate; substitute these components for the extended magazine spring and base plate; and then subsequently assemble the enclosure pieces around the lower end portion of the firearm magazine, as discussed more fully below. Regardless of the particular type and number of any such additional components further included in the magazine extender, embodiments of the firearm magazine extender provide a structurally robust attachment interface for securely affixing the magazine extender onto the lower end portion of a wide assortment of firearm magazines, including firearm magazines having exterior and interior flanges of varying dimensions. Further emphasizing this point, a first example embodiment of a firearm magazine extender suitable for installation on a firearm magazine having interior (outwardly-projecting) flanges is discussed below in connection with FIGS. 1-8, while a second example embodiment of a firearm magazine extender suitable for installation on a firearm magazine having exterior flanges is described below in connection with FIGS. 9-14. The following description is provided by way of non-limiting illustration only and should not be construed to unduly restrict the scope of the appended Claims in any respect.

Figure 2:
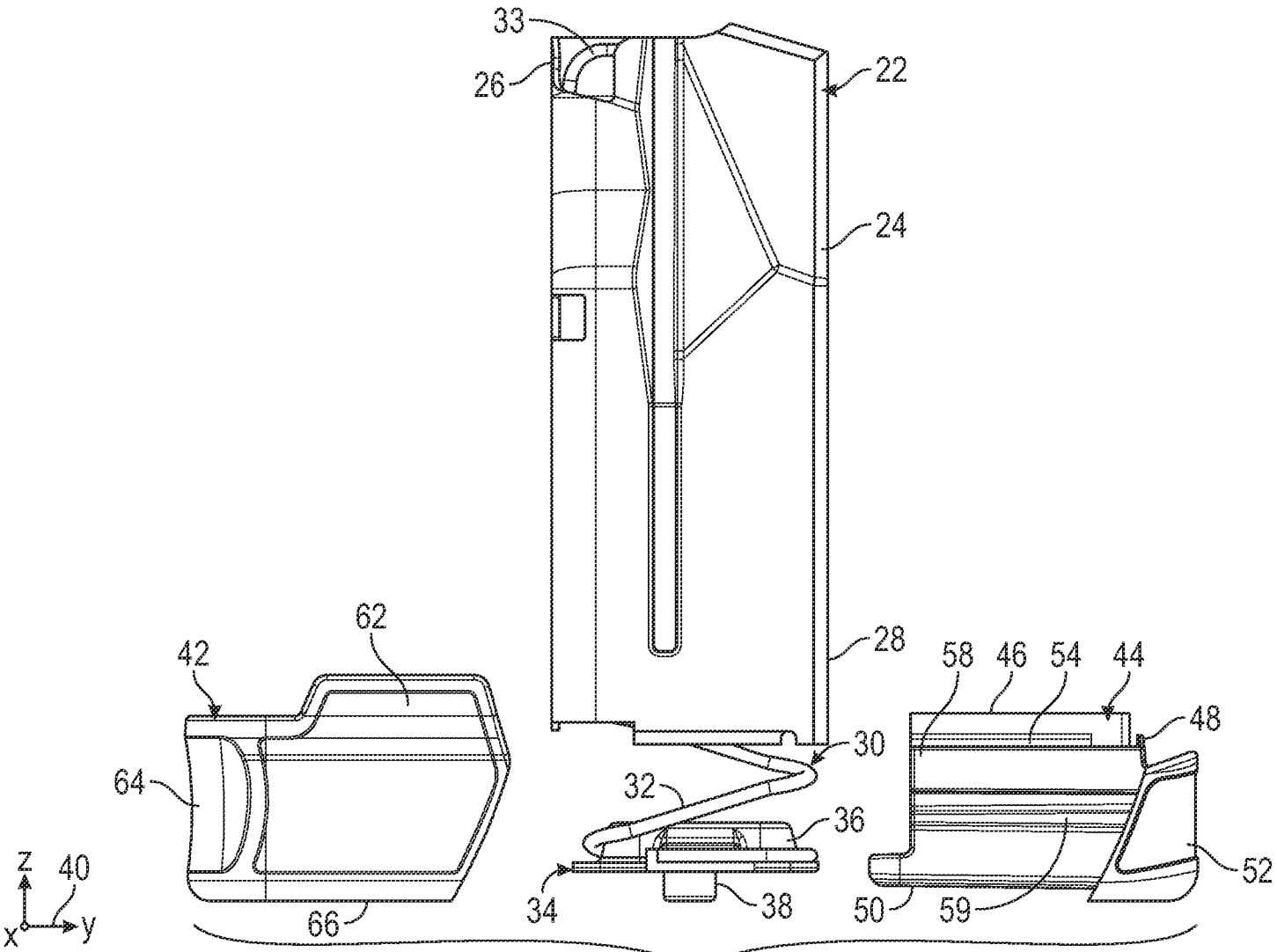
FIG. 2 is a partially-exploded side view of the example magazine extender and the firearm magazine shown in FIG. 1, in which a lower portion of an extended magazine spring and a base plate contained in the magazine extender can be seen.

Example Firearm Magazine Extenders Including Laterally-Interlocking Enclosure Pieces With initial reference to FIGS. 1 and 2, a firearm magazine extender 20 is adapted for installation on a lower portion of a firearm magazine 22, as illustrated in accordance with an example embodiment. In this particular example, firearm magazine 22 includes a tubular magazine body 24 having an upper end portion 26, a lower end portion 28, and interior magazine flanges 58 extending inwardly from interior or inboard surfaces of lower end portion 28 (shown in FIG. 5). Tubular magazine body 24 may be fabricated by rolling or otherwise forming sheet metal into a desired tubular shape, with interior magazine flanges 58 bent into their desired orientation during the metal forming process. This stated, the particular manner in which firearm magazine 22 is manufactured is inconsequential to embodiments of the present disclosure, providing that firearm magazine 22 is fabricated to include at least one flange projecting from a lower surface or sidewall of tubular magazine body 24 permitting magazine extender attachment. As previously indicated, installation of firearm magazine extender 20 permits a user (firearm owner) to expand the round-carrying capacity of firearm magazine 22 to preference without purchase of multiple magazines. The expansion in the round-carrying capacity brought about by attachment of magazine extender 20 will vary among embodiments depending upon, for example, the dimensions of magazine extender 20, taken along a vertical axis thereof (corresponding to the Z-axis of coordinate legend 40 shown in the bottom left of FIGS. 1 and 2). In further embodiments, firearm magazine 22 may have a different form factor, such as a curved or gently arched form factor, or may otherwise vary from the example depicted in the accompanying drawing figures.

In the illustrated embodiment, firearm magazine extender 20 includes an extended magazine spring 30 having an upper end portion (hidden from view) and an opposing, lower end portion 32 (FIG. 2). Lower end portion 32 may be tapered (dimensioned to decrease in coil diameter) relative to the upper end portion of spring 30 to properly fit into the inner cavity of magazine extender 20. Magazine spring 30 extends within the interior channel or chamber of firearm magazine 22, while being compressed between an upper spring follower 33 (partially visible in FIGS. 1 and 2) and a lower base plate 34 (FIG. 2). The upper end of extended magazine spring 30 contacts a lower surface of spring follower 33, while the contoured top surface of spring follower 33 contacts and positions ammunition rounds when loaded into firearm magazine 22. Extended magazine spring 30 will often assume the form of a wireform compression spring having rectangular coils, as shown; however, a different type of mechanical or gas spring (or other bias element) can be substituted for magazine spring 30 in alternative implementations. Opposite spring follower 33, tapered lower end portion 32 of extended magazine spring 30 contacts a spring seat 36, which is defined by upper or top surfaces of base plate 34. As shown most clearly in FIG. 2, spring seat 36 provides a substantially flat surface contacted by the lower end of magazine spring 30, as well as a protrusion around which the lowermost spring coil extends to register or position base plate 34 relative to magazine spring 30; e.g., this upper protrusion may be dimensioned to clip to the lower portion of magazine spring 30 in embodiments. A lower protuberance or "button projection" 38 further extends from base plate 34 in a downward direction away from spring seat 36, as taken along the Z-axis of a coordinate legend 40. Button projection 38 engages into aligning openings or apertures provided in the below-described enclosure pieces 42, 44 to lock magazine extender 20 in its assembled state, as further described below in connection with FIGS. 5-8.

In addition to extended magazine spring 30 and base plate 34, firearm magazine extender 20 includes first and second enclosure pieces 42, 44, which are assembled around lower end portion 28 of firearm magazine 22. The term "enclosure piece," as appearing herein, refers to a structural component (whether a unitary body or a structure assembled from multiple parts) cooperating with at least one additional structural component to form an assembly (effectively, an extended housing) enclosing the lower end portion of a firearm magazine when firearm extender 20 is attached thereto. The particular manner in which enclosure pieces 42, 44 structurally engage or mate will vary among embodiments; and, in certain implementations, a portion of a first enclosure piece (herein, an "inner enclosure piece") may be received into and nest within a second enclosure piece (herein, an "outer enclosure piece"). In the case of magazine extender 20, specifically, enclosure piece 44 is partially received into and nests within enclosure piece 42 when magazine extender 20 is assembled onto firearm magazine 22. For this reason, enclosure piece 44 is more specifically referred to hereafter as "inner enclosure piece 44," while enclosure piece 42 is referred to as "outer enclosure piece 42." Inner enclosure piece 44 may also be described as a male housing component, which plugs or matingly inserts into outer enclosure piece 42 (serving as the female housing component). Although not restricted to being provided in this manner, magazine extender 20 will often be sold or otherwise furnished as a multi-part, user-installable kit containing enclosure pieces 42, 44, extended magazine spring 30, and base plate 34. To install magazine extender 20 on lower end portion 28 of firearm magazine 22, a user initially removes the original (OEM) base plate and magazine spring (which will typically be shorter in free length relative to extended magazine spring 30); substitutes extended magazine spring 30 and base plate 34 for these components; and then assembles enclosure pieces 42, 44 onto lower end portion 28 of firearm magazine 22, as described below in connection with FIGS. 5-8.

Figure 3:
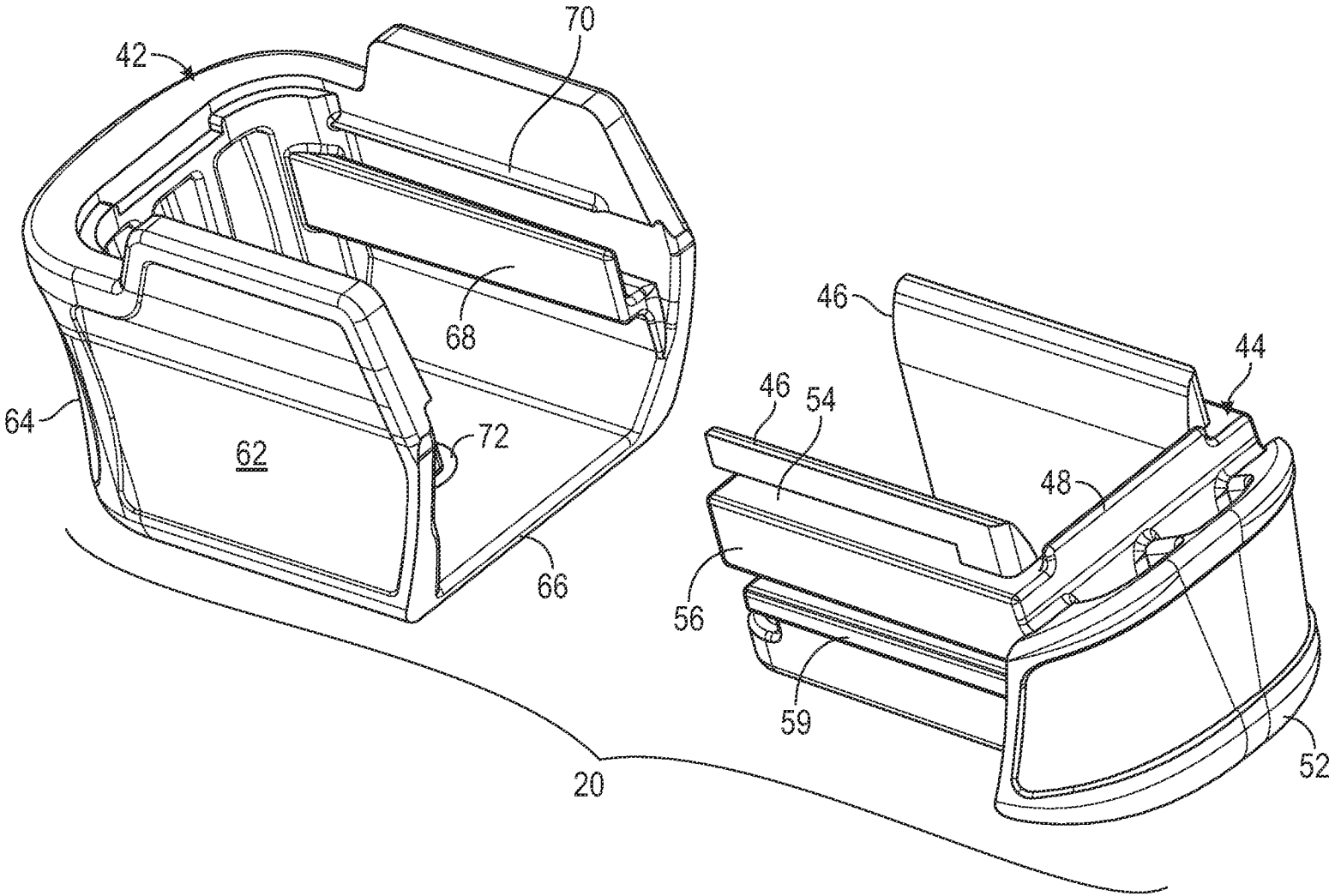
FIGS. 3 and 4 are isometric views of inner and outer enclosure pieces included in the example magazine extender (FIGS. 1 and 2), as shown from different viewing angles and spaced along a longitudinal axis of the magazine extender.
Figure 4:
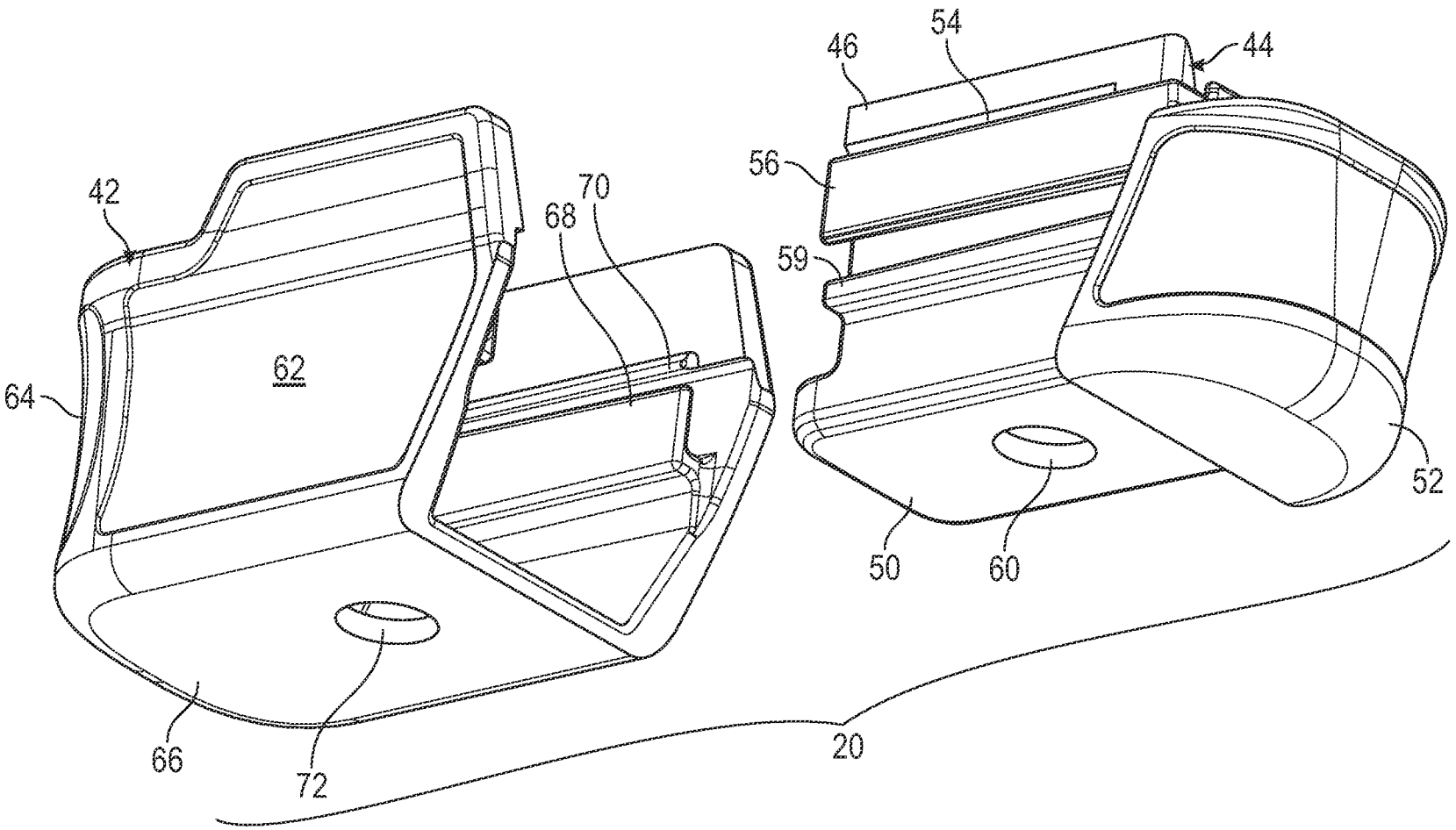
Figure 5:
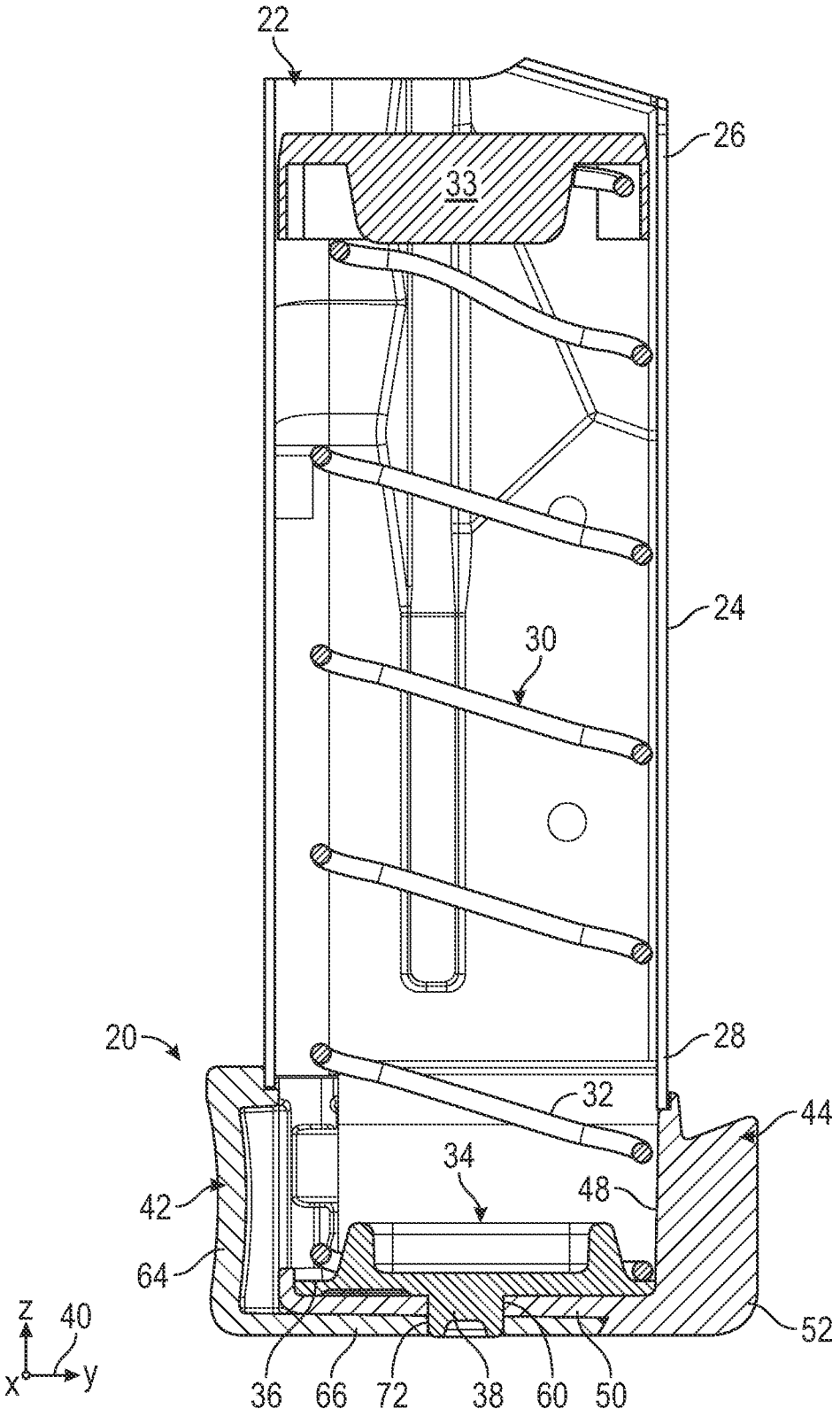
FIG. 5 is a first cross-sectional view of the firearm magazine and the example magazine extender shown in FIGS. 1-4, as taken along a vertical section plane extending orthogonal to a lateral axis of the magazine extender.

Progressing to FIGS. 3 and 4, enclosure pieces 42 and 44 are shown in greater detail and spaced along an "enclosure piece insertion axis"; that is, the axis along which a portion of inner enclosure piece 44 is slidably inserted into outer enclosure piece 42. The enclosure piece insertion axis extends substantially parallel to the longitudinal or fore-aft axis of magazine extender 20 in the illustrated example (corresponding to the Y-axis of coordinate legend 40), which extends perpendicular to the lateral axis of magazine extender 20 (corresponding to the X-axis of coordinate legend 40) and perpendicular to a vertical axis (corresponding to the Z-axis of coordinate legend 40). Initially addressing inner enclosure piece 44, inner enclosure piece 44 includes a laterally-flexible sidewalls 46, an inner endwall or rear wall 48, and a lower or bottom wall 50, which bound or border an internal cavity in which base plate 34 is received. Collectively, laterally-flexible sidewalls 46, rear wall 48, and bottom wall 50 form box-shaped structure, which opens to one side toward outer enclosure piece 42 (here, in a forward direction). Laterally-flexible sidewalls 46 are spaced along the lateral axis of magazine extender 20 (again, perpendicular to the above-described enclosure piece insertion axis and corresponding to the X-axis of coordinate legend 40). Inner enclosure piece 44 further includes enlarged contoured rear mass or trailing facia member 52, which provides additional alignment with outer enclosure piece 42 and a smooth or essentially stepless transition between the abutting interfaces of enclosure pieces 42, 44 when magazine extender 20 is fully assembled.

Retention slots 54 and attachment rails 56 are formed in laterally-flexible sidewalls 46. As appearing herein, the term "retention slot" refers to any groove, slot, opening, or depression into which a magazine flange is received to help retain an enclosure piece in place when the magazine extender is installed on a particular firearm magazine. Comparatively, and as previously noted, the term "attachment rail" refers to any projection extending from a laterally-flexible wall of an enclosure piece and enabling physical attachment or interlocking engagement with lateral-reinforcement rail. In the illustrated embodiment, retention slots 54 are realized as elongated grooves or trenches, which are formed in outwardly-facing surfaces of laterally-flexible sidewalls 46. Retention slots 54 are elongated along longitudinal axes substantially perpendicular to the lateral axis of magazine extender 20 (again, corresponding to the X-axis of coordinate legend 40). Retention slots 54 are dimensioned (that is, imparted with heights, depths, and lengths, as taken along the Z-, X-, and Y-axes of coordinate legend 40, respectively) to provide close-fit, mating engagement with interior magazine flanges 58 when magazine extender 20 is assembled. Comparatively, attachment rails 56 project from laterally-flexible sidewalls 46 in opposing lateral directions at locations proximate, such as locations adjacent and beneath, retention slots 54 formed in the upper, outwardly-facing surfaces of laterally-flexible sidewalls 46. Attachment rails 56 serve as a first set of lateral interlock features, which engage with corresponding interlock features extending inwardly from interior surfaces of outer enclosure piece 42 to physically anchor laterally-flexible sidewalls to the adjacent sidewalls of inner enclosure piece 44. A pair of lower longitudinal ribs 59 further projects from laterally-flexible sidewalls 46 at locations immediately beneath attachment rails 56. Finally, as shown most clearly in FIG. 4, a centrally-located opening or "bottom-center aperture" 60 is further formed through bottom wall 50 of inner enclosure piece 44.

In a manner similar to inner enclosure piece 44, outer enclosure piece 42 includes a pair of laterally-spaced sidewalls 62, a leading endwall or front wall 64, and a lower or bottom wall 66. Two lateral-reinforcement rails 68 project inwardly from laterally-spaced sidewalls 62 in opposing lateral directions (e.g., to the left and right in the orientation shown in FIG. 6) and are structurally configured (positioned, shaped, and dimensioned) to slidably engage with attachment rails 56 of inner enclosure piece 44 when received into outer enclosure piece 42. In this regard, lateral-reinforcement rails 68 may be imparted with hook-shaped (e.g., L-shaped) cross-sectional geometries, which open in an upward direction and, specifically, toward inner lips or longitudinal ledges 70 further formed in inner enclosure piece 44. Similarly, attachment rails 56 may be imparted with hook-shaped (e.g., L-shaped) cross-sectional geometries generally matching or mirroring the geometries of lateral-reinforcement rails 68. However, in contract to lateral-reinforcement rails 68, the hook-shaped cross-sectional geometries of attachment rails 56 open in an opposing, downward direction toward longitudinal ribs 59. Given this complementary dimensioning and positioning of the rails 56, 68, attachment rails 56 readily slide into interlocking engagement with lateral-reinforcement rails 68 when outer enclosure piece 42 is inserted onto inner enclosure piece 42, with rails 56, 68 generally sliding into engagement along a longitudinal axis extending substantially perpendicular to the lateral axis of magazine extender 20. Collectively, lateral-reinforcement rails 68, attachment rails 56, and the surrounding structure of enclosure pieces 42, 44 form a laterally-interlocking interface between enclosure pieces 42, 44*k* as further discussed below in connection with FIG. 6.

A central opening or "bottom-center aperture" 72 is formed through bottom wall 66 of outer enclosure piece 42. Bottom-center aperture 72 formed in outer enclosure piece 42 may have a planform shape and dimensions (e.g., a diameter) substantially matching bottom-center aperture 60 formed in inner enclosure piece 44. When magazine extender 20 is assembled, bottom-center aperture 72 formed in outer enclosure piece 42 is brought into vertical alignment with bottom-center aperture 60 formed in inner enclosure piece 44. As seen in the cross-section of FIG. 5, button projection 38 of base plate 34 is received through aligning apertures 60, 72, with base plate 34 urged in a downward direction (toward bottom wall 66 of outer enclosure piece 42) and pressed against bottom wall 50 of inner enclosure piece 44 by the expansive force of magazine spring 30. So received through apertures 60, 72, button projection 38 mechanically blocks, and thus effectively prevents, sliding disengagement of outer enclosure piece 42 from inner enclosure piece 44 in a forward direction along the above-described enclosure piece engagement or inserting axis. A user can, however, readily disassemble magazine extender 20 by initially depressing button projection 38 (e.g., using a pen, a screwdriver, or similar tool) in an upward toward firearm magazine 22 by a displacement sufficient to clear bottom-center aperture 72. Concurrently, the user slides outer enclosure piece 42 away from inner enclosure piece 44 along the below-described enclosure piece insertion axis (parallel to the Y-axis of coordinate legend 40) to remove outer enclosure piece 42 and disassembly magazine extender 20. A reliable mechanical attachment interface is consequently provided for affixing firearm magazine extender 20 to firearm magazine 22, while enabling magazine extender 20 to be readily removed by a user when desired.

Figure 6:
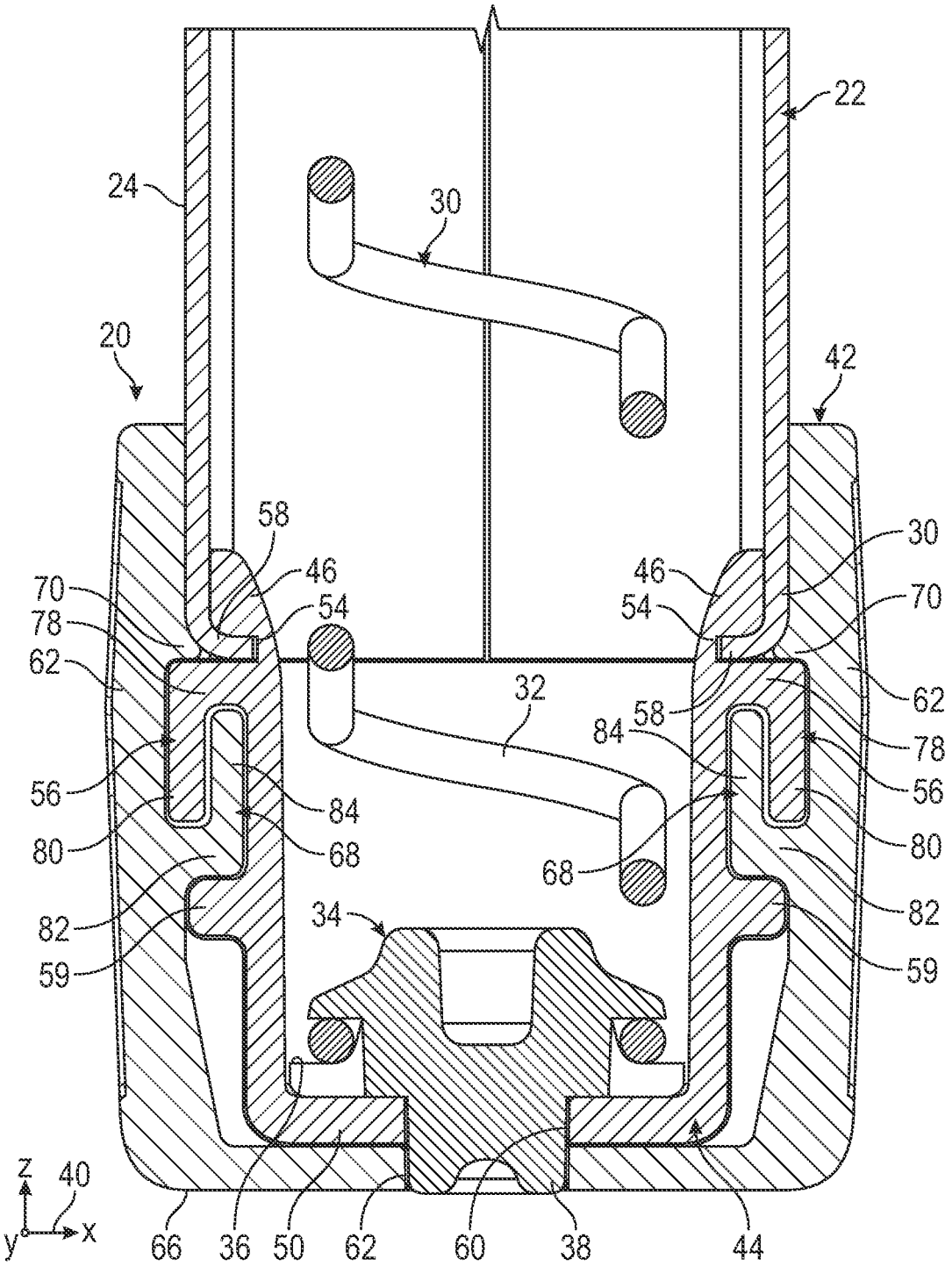
FIG. 6 is a cross-sectional view of a lower portion of the firearm magazine and the example magazine extender, as taken along a second vertical section plane extending parallel to a lateral axis of the magazine extender and depicting an example manner in which the enclosure pieces laterally interlock when the magazine extender is assembled onto the firearm magazine.
Figure 7:
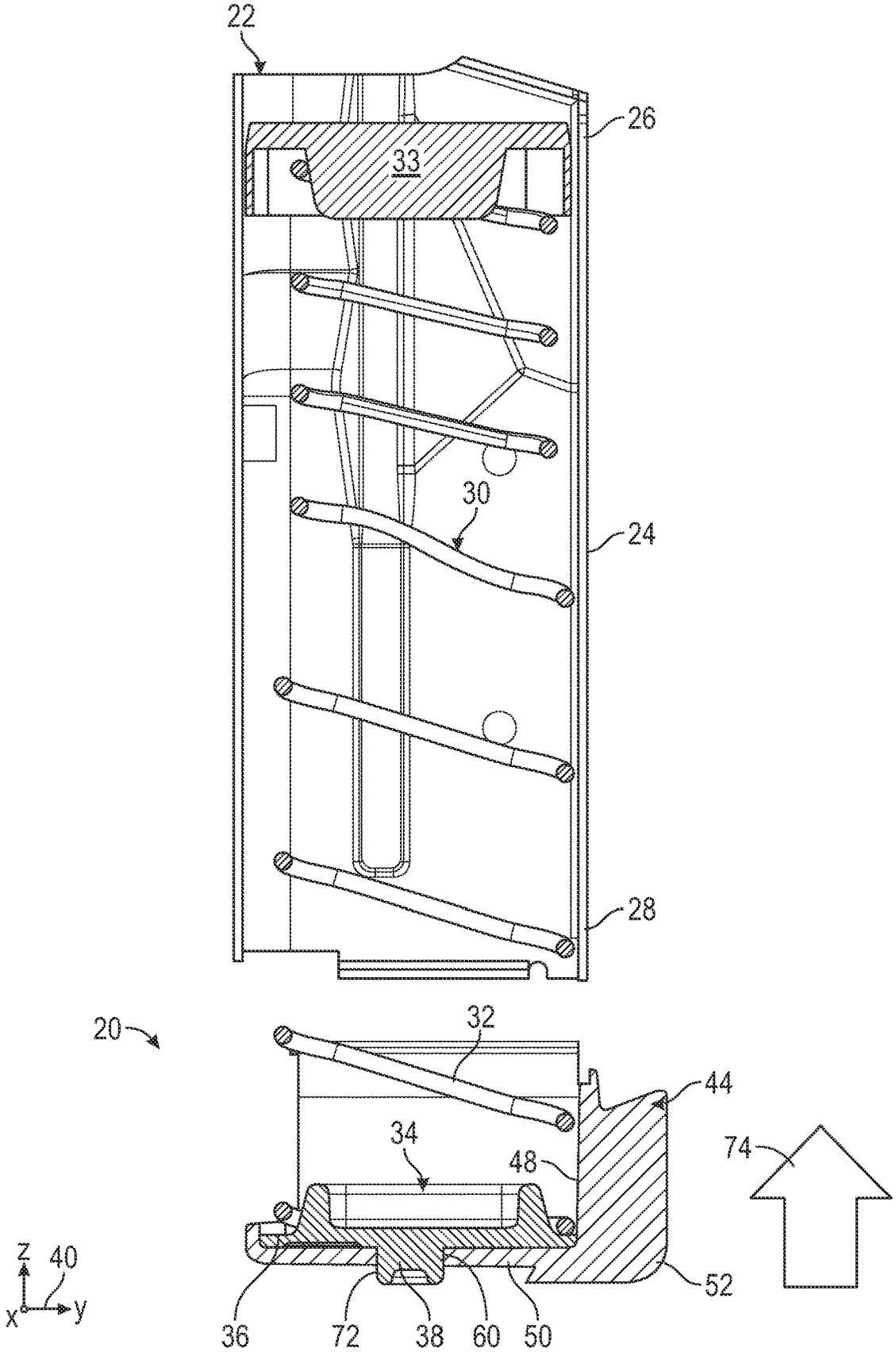
FIGS. 7 and 8 are cross-sectional views of the magazine extender shown in FIGS. 1-6 illustrating, in a step-by-step sequence, an example process for user installation of the magazine extender onto the firearm magazine.

Referring now to FIG. 6, a cross-sectional view of magazine extender 20 and lower end portion 28 of firearm magazine 22 is shown, as taken along a section plane parallel to a vertical axis and parallel to the lateral axis of magazine extender 20 (corresponding to an X-Z plane of coordinate legend 40). Here, it can be seen that inwardly-projecting magazine flanges 58 of firearm magazine 22 are received into retention slots 54, which are formed in an upper portions of laterally-flexible sidewalls 46 of inner enclosure piece 44. Given the lateral flexibility and inherent resiliency of inner enclosure piece 44, the upper end portion of inner enclosure piece 44 may be inserted into the opening provided in lower end portion 28 of firearm magazine 22 via press-fit or snap-fit insertion, with laterally-flexible sidewalls 46 pinching or flexing inwardly in lateral directions (corresponding to the X-axis of coordinate legend 40) to allow the uppermost portions of laterally-flexible sidewalls 46 to clear interior flanges 58 as inner enclosure piece 44 moves in an upward direction. Such an initial insertion step of may be performed by a user after initially installing extended magazine spring 30 and base plate 34 in place; and, subsequently, by positioning inner enclosure piece 44 such that button projection 38 is received into bottom-center aperture 60 provided through bottom wall 50 of inner enclosure piece 44. This press-fit or snap-fit insertion stage of the user-assembly process is illustrated in the cross-section of FIG. 7, with arrow 74 indicating the manner in which the user presses inner enclosure piece 44 upwardly through the bottom opening of lower end portion 28 of firearm magazine 22. After the uppermost end portions of laterally-flexible sidewalls 46 have sufficiently penetrated into firearm magazine 22, retention slots 54 are brought into alignment with inwardly-projecting magazine flanges 58. Inner enclosure piece 44 is at least partly composed of a resilient material; e.g., in at least some embodiments, inner enclosure piece 44 may be molded from a thermoplastic material. Due the resiliency of sidewalls 46, laterally-flexible sidewalls 46 return to the non-deflected, design positions when retention slots 54 align with inwardly-projecting magazine flanges 58, with flanges 58 matingly received into retention slots 54 in the manner shown in FIG. 6.

Inner enclosure piece 44 is produced to permit inward deflection or splaying of laterally-flexible sidewalls 46 supporting press-fit or snap-fit insertion of inner enclosure piece 44 into open lower end portion 28 of firearm magazine 22. The flexibility of laterally-flexible sidewalls 46, and particularly the ability of laterally-flexible sidewalls 46 to readily flex or pinch inwardly toward the centerline of inner enclosure piece 44, enables press-fit or snap-fit engagement of inner enclosure piece 44 with firearm magazine 22. This, in turn, permits interior magazine flanges 58 to register within retention slots 54 of inner enclosure piece 44 despite the internal positioning of flanges 58 within tubular magazine body 24 of firearm magazine 22. As a corollary, however, the flexibility of laterally-flexible sidewalls 46 renders inadvertent detachment of inner enclosure piece 44 undesirably likely, when enclosure piece 44 is considered in isolation. Specifically, due to the flexibility of sidewalls 46, and further due to the potential narrow dimensioning of inwardly-projecting magazine flanges 58, inner enclosure piece 44 may be undesirably prone to detachment from firearm magazine 22 should, for example, dislodgement forces (e.g., shaking or wiggling forces) be applied to inner enclosure piece 44, particularly given the expansive force exerted by magazine spring 30 urging separation of inner enclosure piece (and, more generally, magazine extender 20) and firearm magazine 22. The interlocking relationship between attachment rails 56 and lateral-reinforcement rails 68 significantly deters, if not wholly prevents inward deflection of laterally-flexible sidewalls 46 when outer enclosure piece 42 is mated with inner enclosure piece 44 to preclude unintentional disengagement of interior magazine flanges 58 from retention slots 54, as discussed below.

Figure 8:
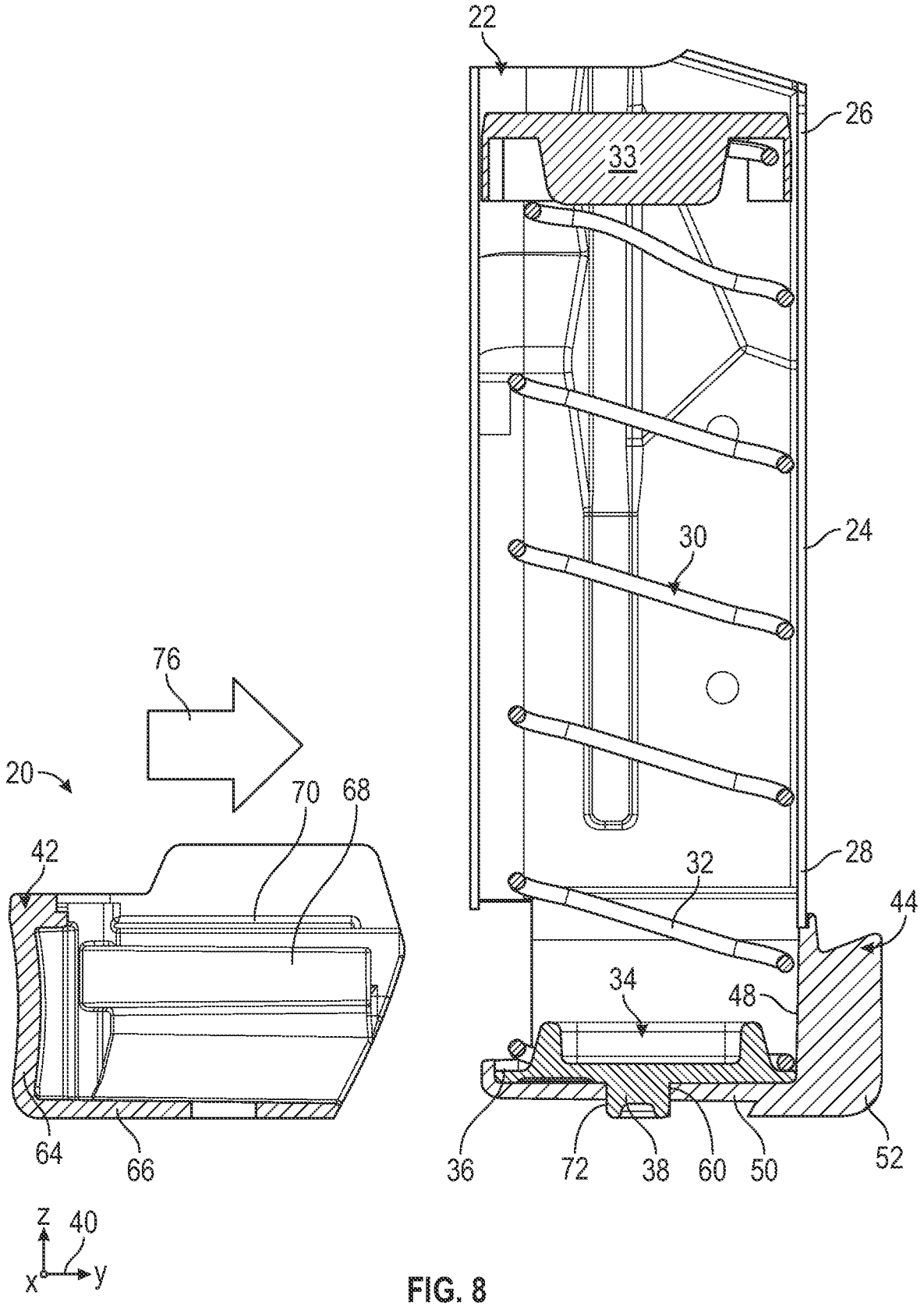
Figure 9:
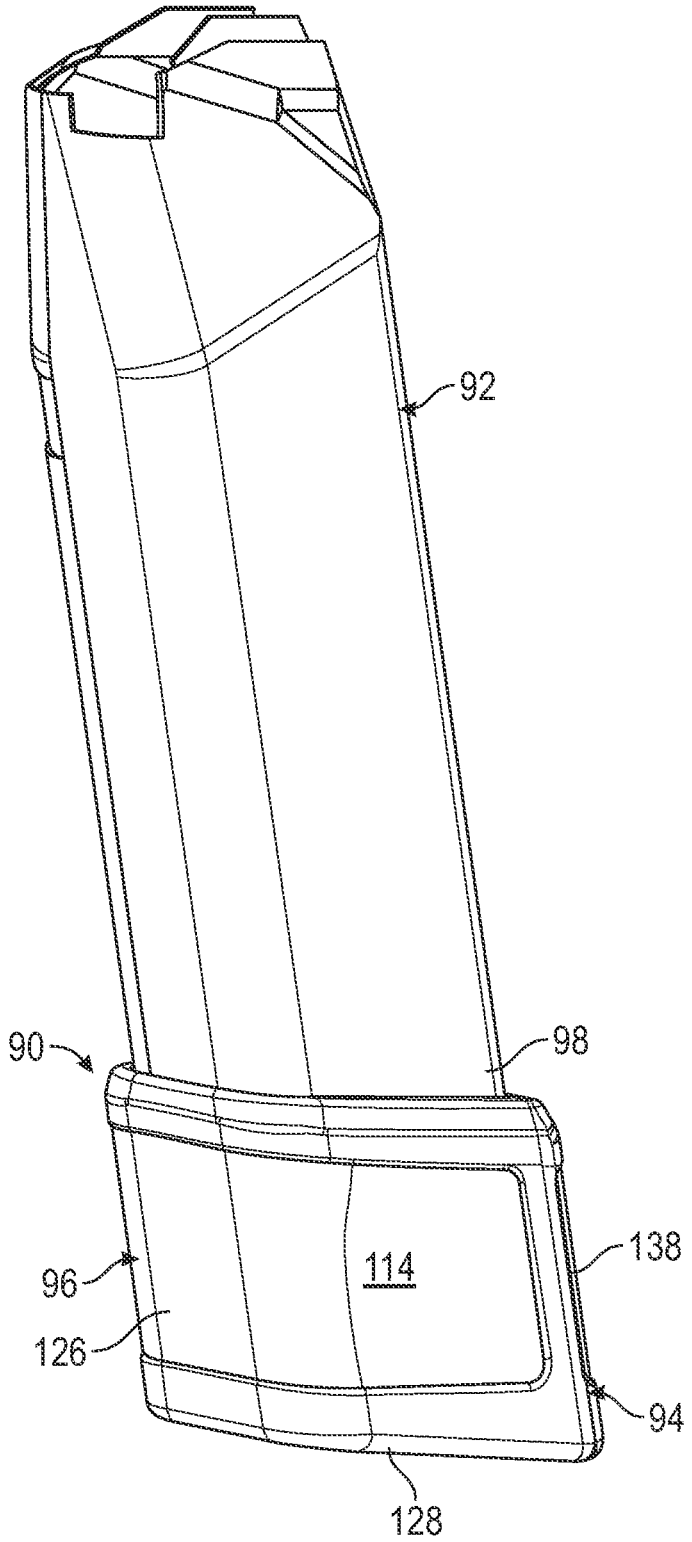
FIG. 9 is an isometric view of a firearm magazine extender installed on a firearm magazine having exterior (outwardly-projecting) flanges, as illustrated in accordance with a second example embodiment of the present disclosure.
Figure 10:
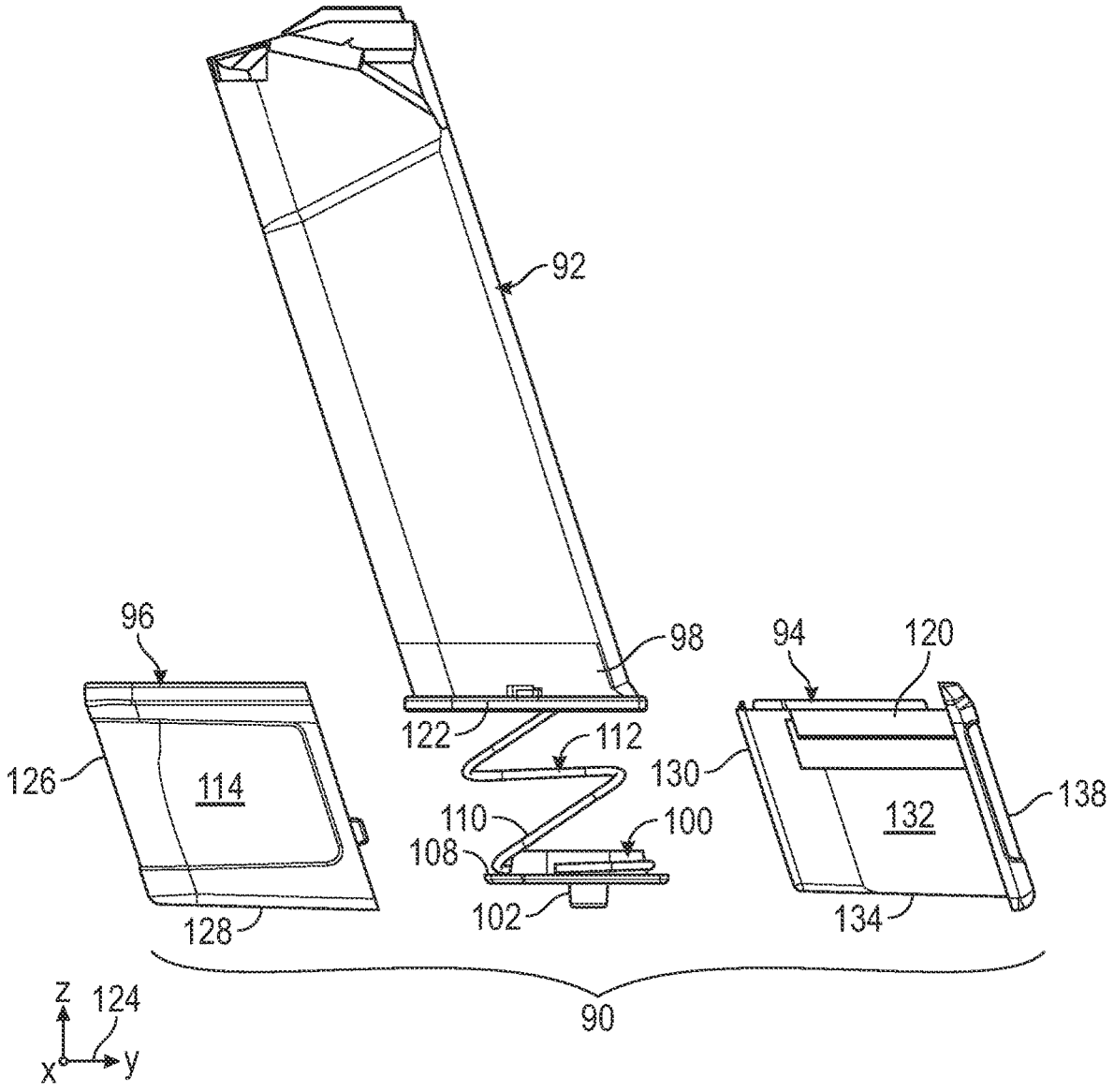
FIG. 10 is a partially-exploded side view of the example firearm magazine extender and the firearm magazine shown in FIG. 9, in which a lower portion of an extended magazine spring and a base plate contained in the magazine extender are visible.
Figure 11:
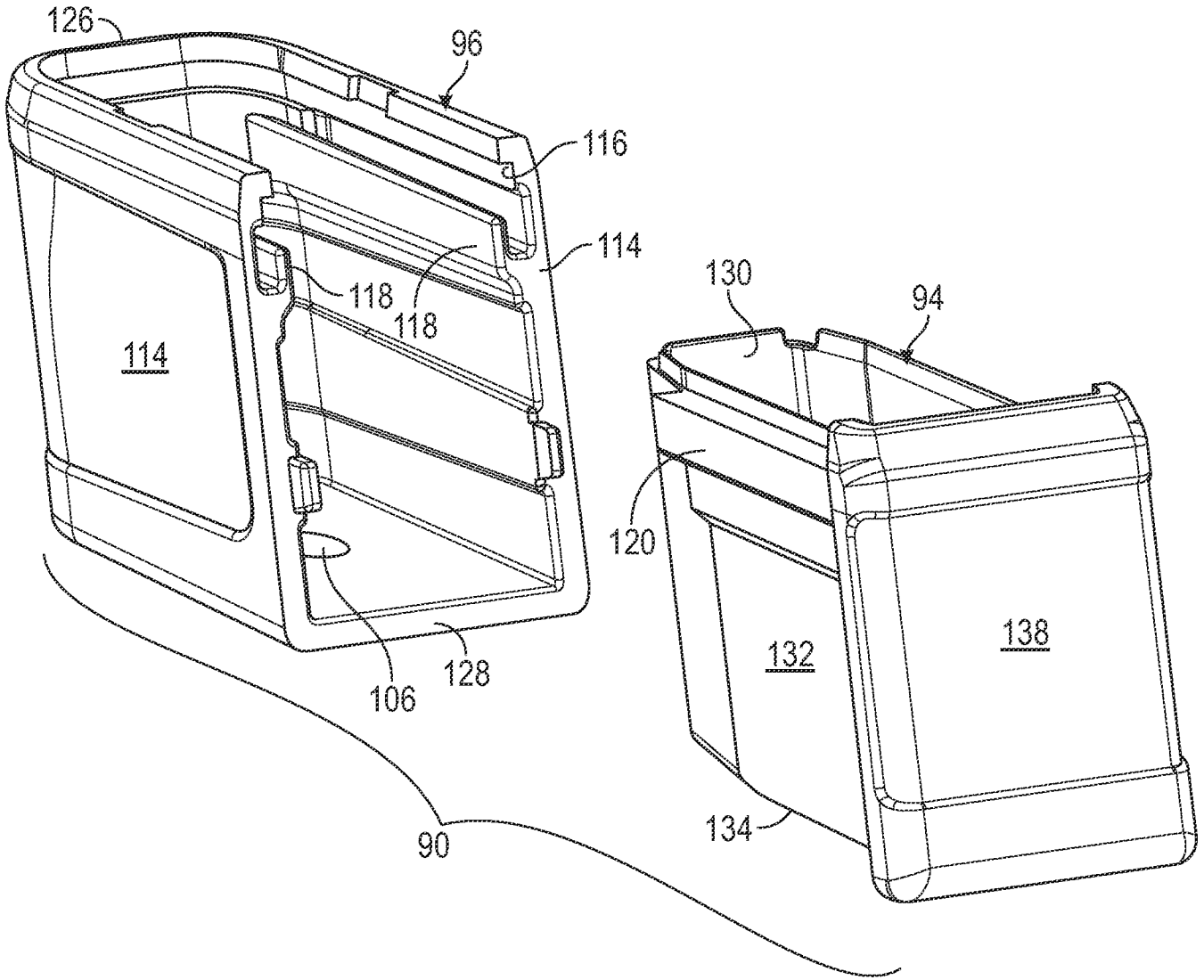
FIGS. 11 and 12 are isometric views of inner and outer enclosure pieces included in the example magazine extender (FIGS. 9 and 10), as shown from different viewing angles and spaced along a longitudinal axis of the magazine extender.
Figure 12:
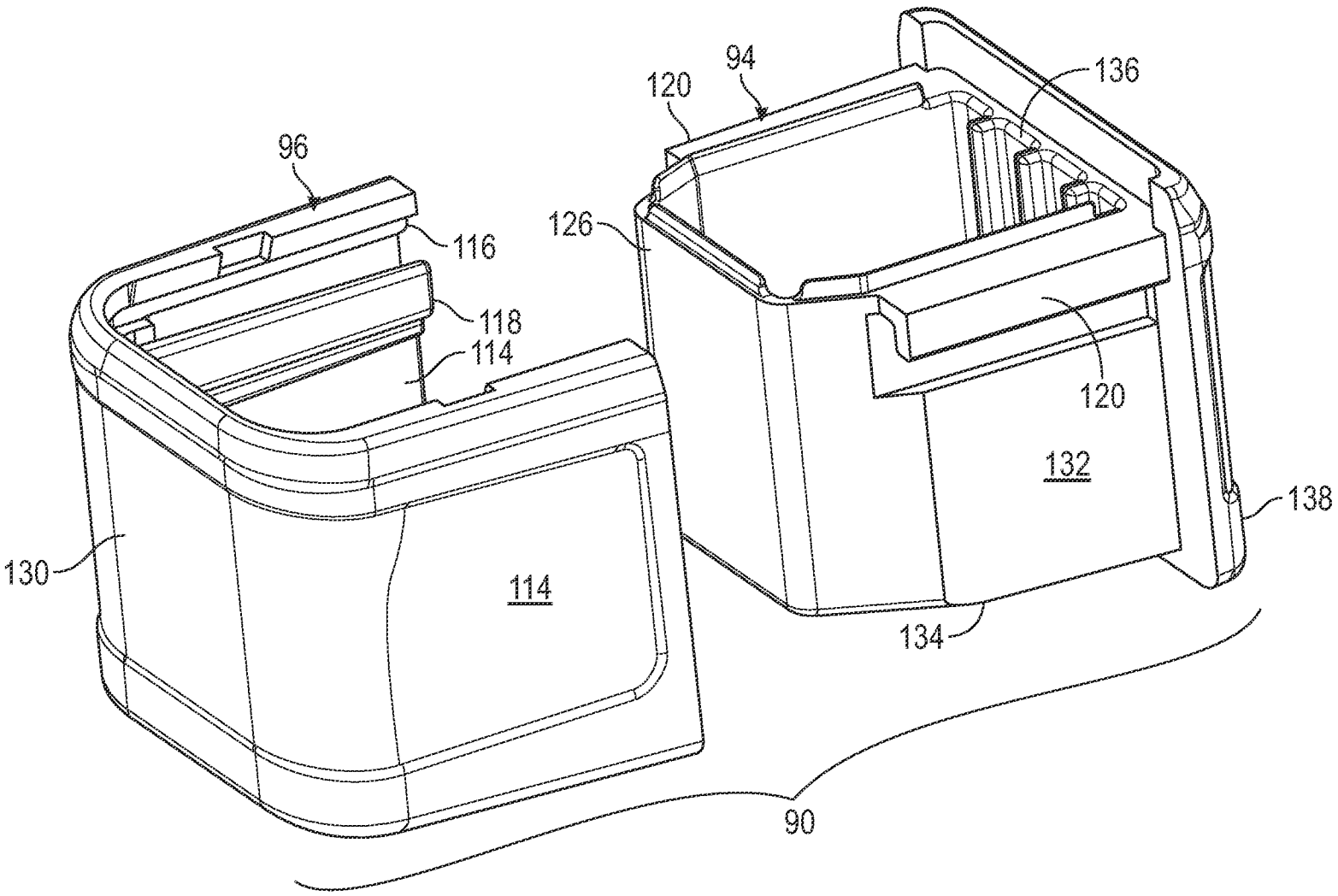
Figure 13:
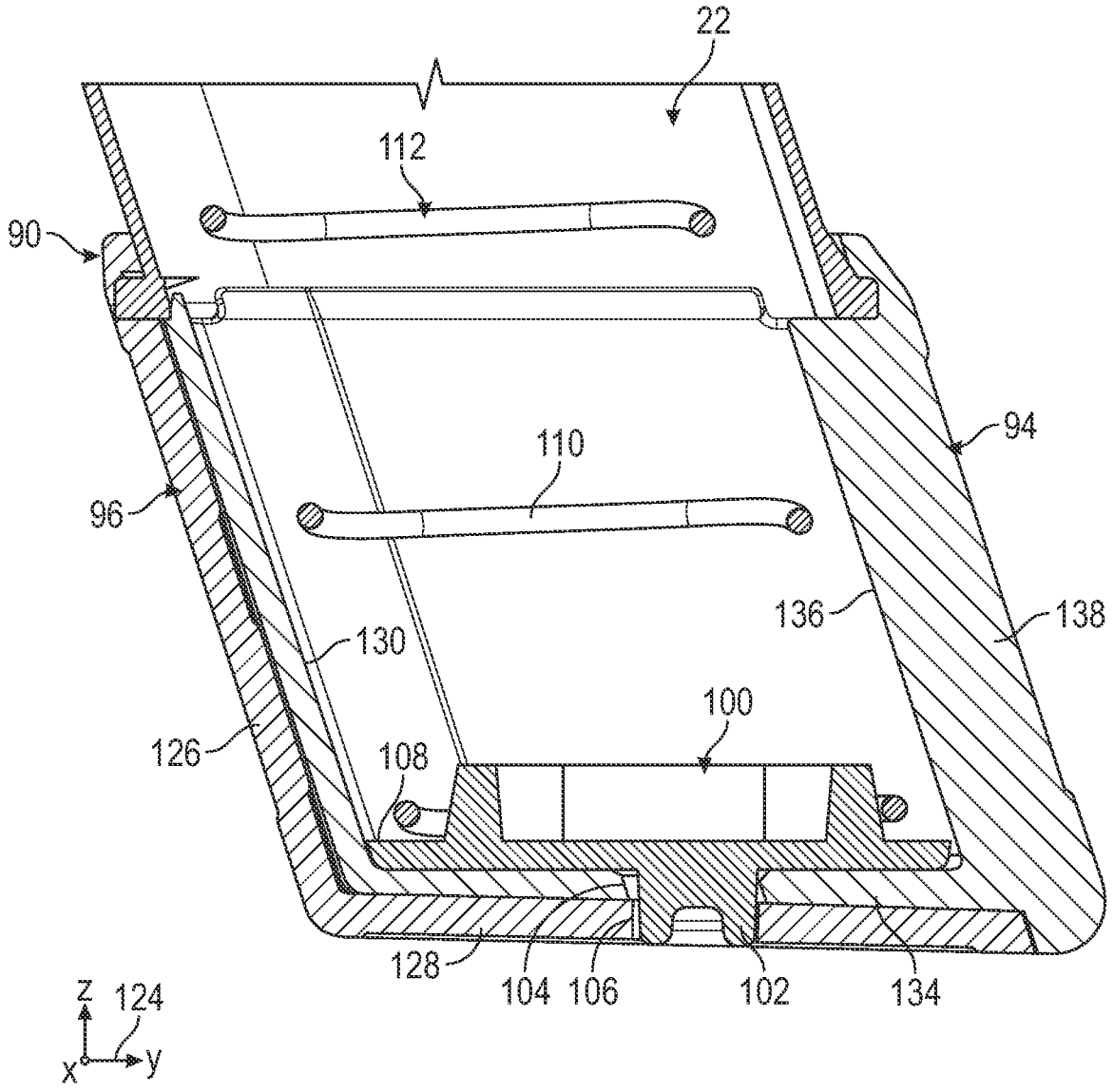
FIG. 13 is a first cross-sectional view of the firearm magazine extender and the firearm magazine shown in FIGS. 9-12, as taken along a vertical section plane extending orthogonal to a lateral axis of the magazine extender.
Figure 14:
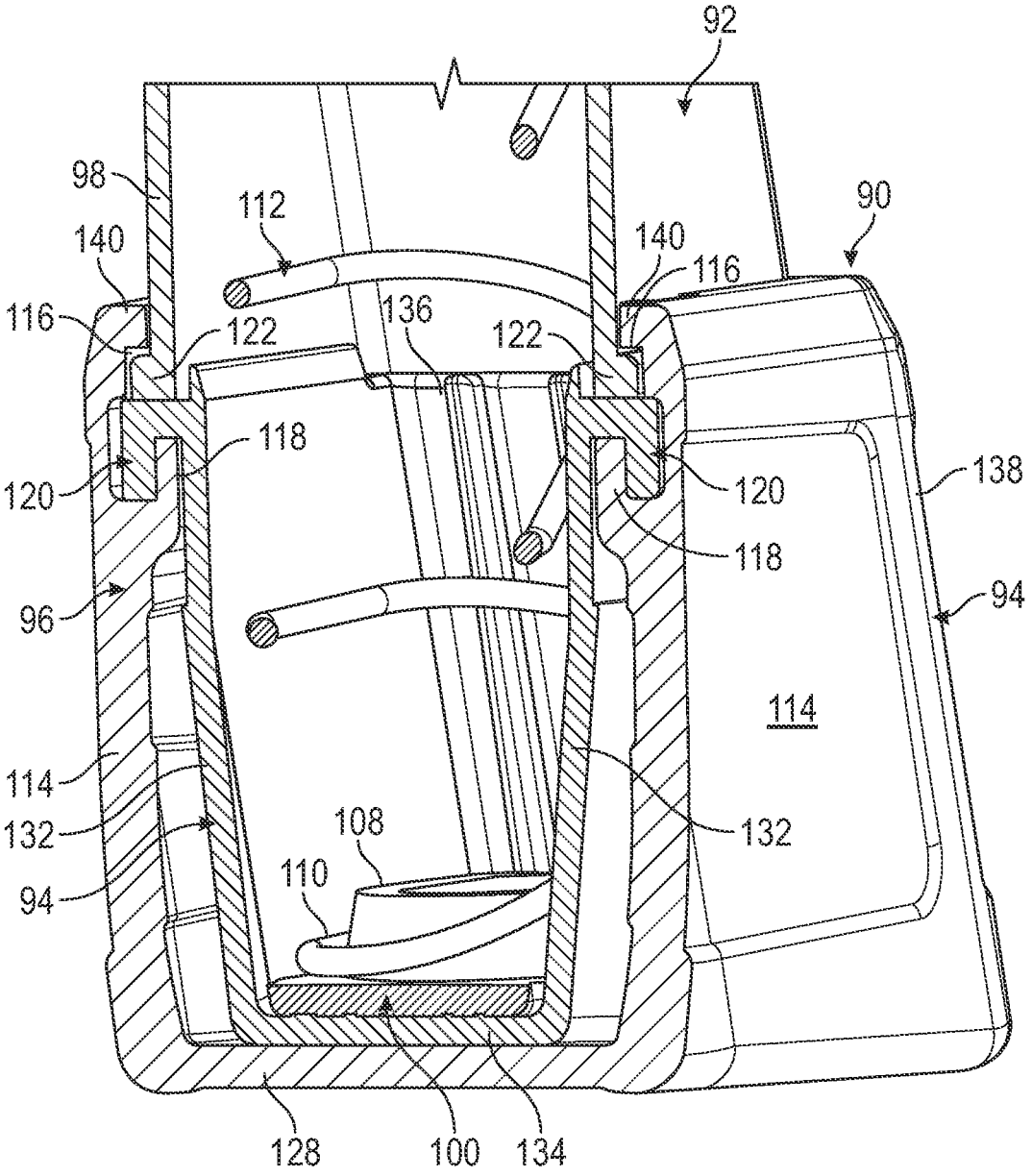
FIG. 14 is a cross-sectional isometric view of the magazine extender and a lower portion of the firearm magazine, as taken along a second vertical section plane parallel to a lateral axis of the magazine extender and depicting an example manner in which the enclosure pieces may laterally interlock when the magazine extender is assembled onto the firearm magazine.

The manner in which outer enclosure piece 42 is inserted onto inner enclosure piece 44 or otherwise placed in mating engagement with inner enclosure piece 44 is further indicated in FIG. 8, with arrow 76 generally indicating the rearward direction in which a user slides outer enclosure piece 42 into engagement with inner enclosure piece 44 along the enclosure piece insertion axis. During this final step of magazine extender installation, the user aligns the mating features of outer enclosure piece 42 with the corresponding features of inner enclosure piece 44. Enclosure piece alignment is facilitated by the sliding surface-to-surface interfaces proved between enclosure pieces 42, 44, noting, for example, that the uppermost surface of bottom wall 66 of outer enclosure piece 42 contacts and slides along bottommost surface of bottom wall 50 of inner enclosure piece 44. Sliding engagement also occurs as attachment rails 56 are received into the open ends of lateral-reinforcement rails 68; and, concurrently, lateral-reinforcement rails 68 are slidably received into the open ends of attachment rails 56. When the leading edge of bottom wall 66 of outer enclosure piece 42 reaches button projection 38, the user further depresses (in an upward direction) button projection 38, which then slides along or "rides" the upper surface of bottom wall 66 until bottom-center aperture 72 is brought into vertical alignment with button projection 38 and bottom-center aperture 60. When apertures 60, 72 are brought into alignment—base plate 34 is pressed downwardly by the expansive force of magazine spring 30, with button projection 38 received through the aligning apertures 60, 72. So positioned, button projection 38 prevents back-sliding or withdrawal of outer enclosure piece 42 relative to inner enclosure piece 44 along the enclosure piece insertion axis in a forward direction, thereby locking enclosure pieces 42, 44 in their desired mating relationship. Further, with magazine extender 20 so assembled, lower tapered end 32 of magazine spring 28 extends between attachment rails 56 and between lateral-reinforcement rails 68 when magazine extender 20 is installed onto lower end portion 28 of firearm magazine 22 and firearm magazine 22 is empty.

In the example of FIGS. 1-8, attachment rails 56 and lateral-reinforcement rails 68 are imparted with hook-shaped (e.g., L-shaped or arm-shaped) cross-sectional geometries. As identified in FIG. 6, attachment rails 56 include laterally-extending shoulder or base sections 78 and vertically-extending arm sections 80. Base sections 78 project outwardly from laterally-flexible sidewalls 46 in opposing directions, while vertically-extending arm sections 80 extend downwardly from base sections 78 to define elongated slots or grooves into which lateral-reinforcement rails 68 are received when outer enclosure piece 42 engages inner enclosure piece 44. Laterally-extending base sections 78 are placed in abutment with lower peripheral surfaces of firearm magazine 22 such that a relatively short, direct (non-tortuous) load path is provided between attachment rails 56 and retention slots 54 to maximize the effectiveness of laterally-interlocking interface. So too do inner ledges or lips 70 of outer enclosure piece 42 contact upper surfaces of attachment rails 56 when magazine extender 20 is installed onto firearm magazine 22 to further position and retain rails 56, 68 in their desired interlocking relationship. Further, and as noted above, lateral-reinforcement rails 68 are imparted with a similar hook-shaped (e.g., L-shaped) cross-sectional geometry, albeit with an inverted orientation. Consequently, as do attachment rails 56, lateral-reinforcement rails 68 include laterally-extending shoulder or base sections 82, which project inwardly from laterally-flexible sidewalls 46 in opposing directions; and vertically-extending arm sections 84, which extend upwardly from base sections 82 to define elongated grooves into which vertically-extending arm sections 80 of attachment rails 56 are received. Additionally, lower surfaces of laterally-extending base sections 82 of attachment rails 56 abut or are vertically-confined by ribs 59 further projecting from sidewalls 46 at location beneath attachment rails 56. In alternative embodiments, attachment rails 56 and/or lateral-reinforcement rails 68 may be imparted with other geometries, providing that lateral-reinforcement rails 68 interlock with attachment rails 56 in a manner deterring lateral deflection of laterally-flexible sidewalls 46 when magazine extender 20 is assembled.

There has thus been provided an example embodiment of a firearm magazine extender (namely, firearm magazine extender 20) capable of securely attaching to a firearm magazine having interior flanges, while also providing a structurally robust, low part count design streamlining user installation of the magazine extender on a chosen firearm magazine. By virtue of the above-described laterally-interlocking features or interface formed in the mating enclosure pieces, secure magazine extender attachment to firearm magazines having interior (inwardly-extending) magazine flanges is achieved; e.g., by producing a first (e.g., inner) enclosure piece to include laterally-flexible sidewalls, which are capable of press-fit insertion into a lower open end of the firearm magazine to allow engagement and registration of the interior magazine flanges within the retention slots formed in the sidewalls. Further, mating attachment or assembly of a second (e.g., outer) enclosure piece bolsters the laterally-flexible sidewalls via the above-described lateral-interlock interface to greatly inhibit, if not wholly prevent lateral sidewall deflection and unintentional flange-slot withdrawal following magazine extender installation. Accordingly, embodiments of the above-described magazine extender can securely attach to various firearm magazines having interior flanges in contrast to most, if not all existing magazine extenders presently offered in the commercial marketplace. This notwithstanding, embodiments of the firearm magazine extender are not restricted solely to usage in conjunction with or installation on firearm magazines having interior flanges, however. Rather, further embodiments of the firearm magazine extender can be readily adapted for usage in conjunction with firearm magazines possessing exterior (outwardly-projecting) flanges of varying dimensions and shapes. To further emphasize this point, additional description of an example firearm magazine extender adapted for installation on a firearm magazine having exterior flanges will now be set-forth below in connection with FIGS. 9-14.

Turning to FIGS. 9-14, a second, non-limiting example embodiment of a firearm magazine extender 90 installed on a firearm magazine 92 is presented. In many respects, example firearm magazine extender 90 is similar to example magazine extender 20 described above in connection with FIGS. 1-8. For example, as does magazine extender 20 (FIGS. 1-8), firearm magazine extender 90 includes an inner enclosure piece 94, an outer enclosure piece 96, a base plate 100, and an extended magazine spring 108. Further, as indicated in the drawing figures, enclosure pieces 94, 96 can be matingly assembled around a lower end portion 98 of firearm magazine 92 by a user to join magazine extender 90 to firearm magazine 92 and increase the round-carrying capacity thereof. When magazine extender 90 is assembled, base plate 100 is received within an inner cavity provided in inner enclosure piece 94, which, in turn, is received within or nests within an inner cavity provided in outer enclosure piece 96. As shown most clearly in FIG. 13, base plate 100 includes a main body having a generally flat, rectangular formfactor and from which a lower button protrusion 102 projects in a downward direction. Button protrusion 102 extends through aligning openings 104, 106 formed in lower walls of enclosure pieces 94, 96, respectively, when magazine extender 90 is assembled. Base plate 100 further includes upper surfaces defining a spring seat 108, which is contacted by a lower tapered end portion 110 of extended magazine spring 112. The opposing, upper end of extended magazine spring 112 abuts a non-illustrated spring follower, which, in turn, contacts magazine rounds when loaded into firearm magazine 92.

First enclosure piece 94 of firearm magazine extender 90 includes a laterally-spaced pair of laterally-flexible sidewalls 114 in which retention slots 116 are formed. Sidewalls 114 are laterally flexible in the sense that, absent the below-described laterally-interlocking relationship between enclosure pieces 94, 96, sidewalls 114 are capable of deflection or displacement in lateral directions to a degree sufficient to permit the unintended withdrawal of the magazine flanges projecting from firearm magazine 92 (e.g., below-described exterior magazine flanges 122) from retention slots 116; and, therefore, unintended magazine extender detachment. The term "laterally flexible," as appearing herein, thus does not require laterally-flexible sidewalls 114 (and, more generally, first enclosure piece 94) to be fabricated from any particular material or that sidewalls 114 deflect in any particular manner during attachment onto firearm magazine 92. A first set of lateral interlock features (here, provided in the form of a pair of attachment rails 118) is located proximate or adjacent (e.g., immediately beneath) retention slots 116. Similarly, second enclosure piece 96 includes a second, corresponding set of lateral interlock features (herein, provided as a pair of lateral-reinforcement rails 120), which matingly engage attachment rails 118 in a laterally-interlocking relationship to deter or inhibit lateral deflection of laterally-flexible sidewalls 114 when magazine extender 90 is assembled. In a manner similar to firearm magazine extender 20 described above in connection with FIGS. 1-8, retention slots 116 of firearm magazine extender 90 receive magazine flanges 122, which project from lower end portion 98 of firearm magazine 92, to attach magazine extender 90 to firearm magazine 92. However, in contrast to example magazine extender 20 (FIGS. 1-8), laterally-flexible sidewalls 114, retention slots 116, and attachment rails 118 are features of an outer enclosure piece (namely, outer enclosure piece 96) rather than features of an inner enclosure piece, while lateral-reinforcement rails 120 are features of an inner enclosure piece (namely, inner enclosure piece 94) rather than feature of an outer enclosure piece. Further, in the example embodiment of FIGS. 9-14, magazine flanges 122 assume the form of external (outwardly-projecting) flanges, which project from lower peripheral edges of firearm magazine 92 in opposing lateral directions (corresponding to the X-axis of coordinate legend 124 shown in FIGS. 10 and 13).

In addition to laterally-flexible sidewalls 114, retention slots 116, and attachment rails 118, outer enclosure piece 96 includes a leading or front endwall 126 and a bottom wall 128. Similarly, inner enclosure piece 94 includes a leading or front endwall 130, sidewalls 132, a bottom wall 134, a trailing or rear interior wall 136, and an enlarged rear portion or trailing facia body 138. As appreciated most readily in FIGS. 11 and 12, enclosure piece 94 forms a box-like structure, which is peripherally enclosed on all sides and which has an open upper end. During assembly, a user initially places inner enclosure piece 94 in an abutting relationship against lower open end portion 98 of firearm magazine 92, with the upper peripheral edges of inner enclosure piece 94 contacting firearm magazine 92 adjacent magazine flanges 122. Inner enclosure piece 94 is not press-fit into the firearm magazine, as was previously the case, but rather is held against the lower or bottommost portion of firearm magazine 92 such that lateral-reinforcement rails 120 abut the lower peripheral edge of firearm magazine 92 at locations adjacent outwardly-projecting magazine flanges 122. Subsequently, the user then slides outer enclosure piece 96 into engagement with inner enclosure piece 94 and outwardly-projecting magazine flanges 122 to secure magazine extender 90 onto lower end portion 98 of firearm magazine 92. As shown most clearly in FIG. 14, sliding engagement or insertion of outer enclosure piece 96 onto inner enclosure piece 94 captures outwardly-projecting magazine flanges 122 between an upper peripheral lip or edge 140 of outer enclosure piece 96 (partially bounding or defining retention slots 116) and lateral-reinforcement rails 120 of inner enclosure piece 94. However, such a structural interface, considered in isolation, provides a relatively tenuous attachment given the inherent flexibility of laterally-flexible sidewalls 114 of outer enclosure piece 96. In this regard, laterally-flexible sidewalls 114 will typically possess some degree of flexibility and resiliency due to the dimensioning of outer enclosure piece 96, the material from which outer enclosure piece 96 is composed, and other factors. Considering this, and considering that outwardly-projecting magazine flanges 122 may be relatively narrow, as measured in lateral directions, unintentional detachment of magazine extender 90 from firearm magazine 92 may occur absent the laterally-interlocking relationship between attachment rails 118 and lateral-reinforcement rails 120, as described below.

To deter undesired lateral deflection of laterally-flexible sidewalls 114, herein an outward direction such that laterally-flexible sidewalls 114 diverge or "splay-out," lateral-reinforcement rails 190 engage attachment rails 118 to effectively physically tie laterally-flexible sidewalls 114 to sidewalls 132 of inner enclosure piece 94. As previously indicated, the respective shapes and dimensions of attachment rails 118 and lateral-reinforcement rails 190 can and will differ among embodiments, providing that corresponding sets of rails 118, 120 engage in a lateral-interlocking relationship when magazine extender 90 is assembled onto firearm magazine 92. As shown most clearly in FIG. 6, attachment rails 118 and lateral-reinforcement rails 120 are each formed to have hook-shaped (e.g., L-shaped) cross-sectional geometries in the present example implementation. Specifically, attachment rails 118 may be imparted with hook-shaped cross-sectional geometries, which open in a first (here, upward) direction toward retention slots 116. Lateral-reinforcement rails 120 are likewise formed to have corresponding hooked-shaped cross-sectional geometries opening in a second, opposing (here, downward) direction. Attachment rails 118 consequently serve as physical interface features or anchor points for tying or linking laterally-flexible sidewalls 114 of inner enclosure piece 94 to adjacent sidewalls 132 of outer enclosure piece 96 via interlocking engagement with lateral-reinforcement rails 120.

When firearm magazine extender 90 is properly assembled onto the lower portion of firearm magazine 92, and specifically as outer enclosure piece 94 is slid onto inner enclosure piece 92, lateral-reinforcement rails 120 thus hook into, laterally clasp, or otherwise laterally interlock with attachment rails 118. The interlocking relationship of lateral-reinforcement rails 120 and attachment rails 118 physically tie or anchor laterally-flexible sidewalls 114 of inner enclosure piece 94 to sidewalls 132 of outer enclosure piece 96, taken in lateral directions (again, corresponding to the X-axis of coordinate legend 124). Due to the laterally-interlocking relationship between rails 118, 120, outward deflection or splaying of laterally-flexible walls 114 results in co-deflection of adjacent sidewalls 132 of outer enclosure piece 96. A high lateral stiffness, dual-wall structure is consequently created inhibiting outboard lateral deflection or splay of laterally-flexible sidewalls 114, which may otherwise permit disengagement of external magazine flanges 122 from retention slots 116. In this manner, firearm magazine extender 90 is affixed to firearm magazine 92 in a structurally robust, highly secure manner minimizing the likelihood of inadvertent detachment from firearm magazine 92, even in the presence of mechanical impact (shock) forces or adverse operational conditions. Concurrently, firearm magazine extender 90 is readily manufacturable, possess relatively few components, and can be attached by a user to a selected firearm magazine through a relatively straightforward installation process.

CONCLUSION

There has thus been provided multiple examples of firearm magazine extenders capable of securely attaching to a broad range of firearm magazines, including firearm magazines having laterally-extending flanges having relatively narrow widths and located on the interior or exterior of the firearm magazine body. Beneficially, embodiments of the magazine extender facilitate user installation through engagement of magazine flanges into retention slots formed in laterally-flexible sidewalls of a first enclosure piece, while precluding the likelihood of flange disengagement from the retention slots through the provision of laterally-interlocking interfaces formed between the first enclosure piece and a second, mating enclosure piece. By virtue of such structural features, user installation is streamlined, while likelihood of unintended detachment of the magazine extender from a firearm magazine is significantly reduced, if not eliminated, even in the unlikely event of the application of significant dislodgement (e.g., mechanical impact) forces to the magazine extender. The disclosed magazine extenders are also amenable to cost effective manufacture due, at least in part, to low part count design and the ability to fabricate the enclosures pieces from a moldable material, such as a thermoplastic containing or lacking fillers, utilizing a relatively straightly forward injection or transfer molding process. This stated, embodiments of the firearm magazine extender are not restricted to fabrication from any particular material or any particular manufacturing technique.

Embodiments of the firearm magazine extender are installable onto a firearm magazine having a lower end portion from which magazine flanges project, whether in inward or outward directions. The firearm magazine extender includes a first enclosure piece, a second enclosure piece, and a laterally-interlocking interface formed between the first and second enclosure pieces. The first enclosure piece includes, in turn, laterally-flexible sidewalls spaced along a lateral axis of the firearm magazine extender, and retention slots formed in the laterally-flexible sidewalls and into which the magazine flanges engage when the first enclosure piece is fit onto the lower end portion of the firearm magazine. The second enclosure piece is configured to matingly engage the first enclosure piece and cooperate therewith to enclose the lower end portion of the firearm magazine. The laterally-interlocking interface inhibits (structurally deters or prevents) deflection of the laterally-flexible sidewalls and disengagement of the magazine flanges from the retention slots when the firearm magazine extender is installed on the firearm magazine. In certain implementations, the laterally-interlocking interface includes: (i) attachment rails projecting from the laterally-flexible sidewalls of the first enclosure piece in opposing lateral directions; and (ii) lateral-reinforcement rails projecting from sidewalls of the second enclosure piece and interlocking with the attachment rails when the firearm magazine extender is installed on the firearm magazine. Additionally, the attachment rails may extend from the laterally-flexible sidewalls at locations adjacent and beneath the retention slots, the lateral-reinforcement rails slidably engage the attachment rails along a longitudinal axis extending substantially perpendicular to the lateral axis, and/or the attachment rails may be located between the lower end portion of the firearm magazine and the lateral-reinforcement rails when the firearm magazine extender is installed on the firearm magazine.

In further embodiments, the firearm magazine extender includes an inner enclosure piece and an outer enclosure piece, which matingly engage to enclose the lower end portion of the firearm magazine when the firearm magazine extender is installed on a firearm magazine having interior (inwardly-extending) magazine flanges. The inner enclosure piece includes laterally-flexible sidewalls spaced along a lateral axis of the firearm magazine extender, retention slots formed in the laterally-flexible sidewalls and into which the magazine flanges engage when the inner enclosure piece is inserted into the lower end portion of the firearm magazine, and a first set of lateral interlock features proximate the retention slots and projecting from the laterally-flexible sidewalls in opposing lateral directions. Comparatively, the outer enclosure piece includes a second set of lateral interlock features interlocking with the first set of lateral interlock features to inhibit inward lateral deflection of the laterally-flexible sidewalls and disengagement of the magazine flanges from the retention slots when the firearm magazine extender is installed on the firearm magazine. In at least some realizations, the first set of lateral interlock features may assume the form of attachment rails projecting from the laterally-flexible sidewalls at locations adjacent and beneath the retention slots. Additionally or alternatively, in embodiments, the second set of lateral interlock features may assume the form of lateral-reinforcement rails shaped, sized, and position to slidably engage the attachment rails along a longitudinal axis substantially perpendicular to the lateral axis. In such embodiments, the attachment rails may be imparted with hook-shaped cross-sectional geometries opening in downward directions, while the lateral-reinforcement rails are imparted with hook-shaped cross-sectional geometries opening in upward directions.

In still further implementations, a firearm magazine extender includes an outer enclosure piece and an inner enclosure piece, which are adapted for mating assembly onto the lower end portion of a firearm magazine having external (outwardly-projecting) magazine flanges. The outer enclosure piece includes laterally-flexible sidewalls spaced along a lateral axis of the firearm magazine extender, retention slots formed in the laterally-flexible sidewalls and into which the magazine flanges engage when the outer enclosure piece is installed on the lower end portion of the firearm magazine, and attachment rails proximate the retention slots and projecting from the laterally-flexible sidewalls in opposing lateral directions. The inner enclosure piece includes lateral-reinforcement rails interlocking with the attachment rails to inhibit outward lateral deflection of the laterally-flexible sidewalls and disengagement of the magazine flanges from the retention slots when the firearm magazine extender is installed on the firearm magazine. In embodiments, the lower end portion of the firearm magazine may contact or abut the inner enclosure piece and the lateral-reinforcement rails when the firearm magazine extender is assembled onto the firearm magazine.

Terms such as "comprise," "include," "have," and variations thereof are utilized herein to denote non-exclusive inclusions. Such terms may thus be utilized in describing processes, articles, apparatuses, and the like that include one or more named steps or elements, but may further include additional unnamed steps or elements. While at least one example embodiment has been presented in the foregoing Detailed Description, it should be appreciated that a vast number of variations exist. It should also be appreciated that the example embodiment or example embodiments are only examples, and are not intended to limit the scope, applicability, or configuration of the invention in any way. Rather, the foregoing Detailed Description will provide those skilled in the art with a convenient road map for implementing an example embodiment of the invention. Various changes may be made in the function and arrangement of elements described in an example embodiment without departing from the scope of the invention as set-forth in the appended Claims.

What is claimed is:

1. A firearm magazine extender installable onto a firearm magazine having a lower end portion from which magazine flanges project, the firearm magazine extender comprising:

a first enclosure piece, comprising:

laterally-flexible sidewalls spaced along a lateral axis of the firearm magazine extender; and retention slots formed in the laterally-flexible sidewalls and into which the magazine flanges engage when the first enclosure piece is fit onto the lower end portion of the firearm magazine;

a second enclosure piece configured to matingly engage the first enclosure piece and cooperate therewith to enclose the lower end portion of the firearm magazine; and a laterally-interlocking interface formed between the first enclosure piece and the second enclosure piece, the laterally-interlocking interface inhibiting deflection of the laterally-flexible sidewalls and disengagement of the magazine flanges from the retention slots when the firearm magazine extender is installed on the firearm magazine.

2. The firearm magazine of claim 1, wherein the laterally-interlocking interface comprises:

attachment rails projecting from the laterally-flexible sidewalls of the first enclosure piece in opposing lateral directions; and lateral-reinforcement rails projecting from sidewalls of the second enclosure piece and interlocking with the attachment rails when the firearm magazine extender is installed on the firearm magazine.

3. The firearm magazine extender of claim 2, wherein the attachment rails extend from the laterally-flexible sidewalls at locations adjacent and beneath the retention slots.

4. The firearm magazine extender of claim 2, wherein the lateral-reinforcement rails slidably engage the attachment rails along a longitudinal axis extending substantially perpendicular to the lateral axis.

5. The firearm magazine extender of claim 2, wherein the attachment rails are located between the lower end portion of the firearm magazine and the lateral-reinforcement rails when the firearm magazine extender is installed on the firearm magazine.

6. The firearm magazine extender of claim 2, wherein the attachment rails and the lateral-reinforcement rails comprise hook-shaped cross-sectional geometries, as taken in a cross-section plane extending parallel to the lateral axis.

7. The firearm magazine extender of claim 6, wherein the hook-shaped cross-sectional geometries of the lateral-reinforcement rails open in a first direction, while the hook-shaped cross-sectional geometries of the attachment rails open in a second direction opposite the first direction.

8. The firearm magazine extender of claim 2, further comprising:

a magazine spring having a lower tapered end; and a base plate, comprising:

a spring seat engaged by the lower tapered end of the magazine spring; and a button projection opposite the spring seat, the button projection received in aligning apertures formed in the first enclosure piece and the second enclosure piece when the firearm magazine extender is installed onto the lower end portion of the firearm magazine.

9. The firearm magazine extender of claim 8, wherein the lower tapered end of the magazine spring extends between the attachment rails and between the lateral-reinforcement rails when the firearm magazine extender is installed onto the lower end portion of the firearm magazine and the firearm magazine is empty.

10. The firearm magazine extender of claim 1, wherein the magazine flanges comprise interior magazine flanges extending inwardly from a tubular body of the firearm magazine; and wherein the first enclosure piece is an inner enclosure piece, while the second enclosure piece is an outer enclosure piece into which the inner enclosure piece inserts.

11. The firearm magazine extender of claim 10, wherein the inner enclosure piece is inserted into the lower end portion of the firearm magazine to engage the interior magazine flanges into the retention slots.

12. The firearm magazine extender of claim 10, wherein the laterally-interlocking interface comprises:

attachment rails projecting outwardly from the laterally-flexible sidewalls of the inner enclosure piece; and lateral-reinforcement rails projecting from sidewalls of the outer enclosure piece in inward directions to matingly engage the attachment rails when the firearm magazine extender is installed on the firearm magazine.

13. The firearm magazine extender of claim 1, wherein the magazine flanges comprise exterior magazine flanges extending outwardly from a tubular magazine body of the firearm magazine; and wherein the second enclosure piece is an inner enclosure piece, while the first enclosure piece is an outer enclosure piece into which the inner enclosure piece inserts.

14. The firearm magazine extender of claim 13, wherein the laterally-interlocking interface comprises:

attachment rails projecting from the laterally-flexible sidewalls of the outer enclosure piece in inward directions; and lateral-reinforcement rails projecting from sidewalls of the inner enclosure piece in outward directions to matingly engage the attachment rails when the firearm magazine extender is installed on the firearm magazine.

15. The firearm magazine extender of claim 14, wherein the inner enclosure piece is held in abutment against the lower end portion of the tubular magazine body by the inner enclosure piece when the firearm magazine extender is installed on the firearm magazine.

16. A firearm magazine extender installable onto a firearm magazine having a lower end portion from which interior magazine flanges project in laterally inward directions, the firearm magazine extender comprising:

an inner enclosure piece, comprising:

laterally-flexible sidewalls spaced along a lateral axis of the firearm magazine extender;

retention slots formed in the laterally-flexible sidewalls and into which the interior magazine flanges engage when the inner enclosure piece is inserted into the lower end portion of the firearm magazine; and a first set of lateral interlock features proximate the retention slots and projecting from the laterally-flexible sidewalls in opposing lateral directions; and an outer enclosure piece configured to matingly engage the inner enclosure piece and cooperate therewith to enclose the lower end portion of the firearm magazine, the outer enclosure piece comprising a second set of lateral interlock features interlocking with the first set of lateral interlock features to inhibit inward lateral deflection of the laterally-flexible sidewalls and disengagement of the interior magazine flanges from the retention slots when the firearm magazine extender is installed on the firearm magazine.

17. The firearm magazine extender of claim 16, wherein the first set of lateral interlock features comprises attachment rails projecting from the laterally-flexible sidewalls at locations adjacent and beneath the retention slots.

18. The firearm magazine extender of claim 17, wherein the second set of lateral interlock features comprises lateral-reinforcement rails shaped, sized, and position to slidably engage the attachment rails along a longitudinal axis substantially perpendicular to the lateral axis.

19. The firearm magazine extender of claim 18, wherein the attachment rails are imparted with hook-shaped cross-sectional geometries opening in downward directions, while the lateral-reinforcement rails are imparted with hook-shaped cross-sectional geometries opening in upward directions.

20. A firearm magazine extender installable onto a firearm magazine having a lower end portion from which external magazine flanges project in laterally outward directions, the firearm magazine extender comprising:

an outer enclosure piece, comprising:

laterally-flexible sidewalls spaced along a lateral axis of the firearm magazine extender;

retention slots formed in the laterally-flexible sidewalls and into which the external magazine flanges engage when the outer enclosure piece is installed on the lower end portion of the firearm magazine; and attachment rails proximate the retention slots and projecting from the laterally-flexible sidewalls in opposing lateral directions; and an inner enclosure piece configured to matingly engage outer inner enclosure piece and cooperate therewith to enclose the lower end portion of the firearm magazine, the inner enclosure piece comprising lateral-reinforcement rails interlocking with the attachment rails to inhibit outward lateral deflection of the laterally-flexible sidewalls and disengagement of the external magazine flanges from the retention slots when the firearm magazine extender is installed on the firearm magazine.

* * * * *